US010559294B2

(12) United States Patent
Magariyachi et al.

(10) Patent No.: US 10,559,294 B2
(45) Date of Patent: Feb. 11, 2020

(54) ACOUSTIC TUBE AND ACOUSTIC REPRODUCTION APPARATUS

(71) Applicant: Sony Corporation, Tokyo (JP)

(72) Inventors: Tetsu Magariyachi, Kanagawa (JP); Yuhki Mitsufuji, Tokyo (JP); Yu Maeno, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 16/087,227

(22) PCT Filed: Mar. 17, 2017

(86) PCT No.: PCT/JP2017/010867
§ 371 (c)(1),
(2) Date: Sep. 21, 2018

(87) PCT Pub. No.: WO2017/169886
PCT Pub. Date: Oct. 5, 2017

(65) Prior Publication Data

US 2019/0051284 A1 Feb. 14, 2019

(30) Foreign Application Priority Data

Mar. 31, 2016 (JP) ..... 2016-072168

(51) Int. Cl.
*H04R 1/20* (2006.01)
*G10K 11/22* (2006.01)
*H04R 1/34* (2006.01)

(52) U.S. Cl.
CPC ..... *G10K 11/22* (2013.01); *H04R 1/34* (2013.01)

(58) Field of Classification Search
CPC ..... H04R 31/00; H04R 1/288; H04R 1/023; H04R 1/345; H04R 1/025; H04R 1/22;
(Continued)

(56) References Cited

U.S. PATENT DOCUMENTS 5,940,347 A 8/1999 Raida et al.
8,351,629 B2 * 1/2013 Parker ..... H04R 1/2857 381/337

(Continued)

FOREIGN PATENT DOCUMENTS

CN 101674509 A 3/2010
CN 101933341 A 12/2010

(Continued)

OTHER PUBLICATIONS

K.R. Holland et al. "A Low Cost End-Fire Acoustic Radiator", 1991.*

(Continued)

*Primary Examiner* — Amir H Etesam

(74) *Attorney, Agent, or Firm* — Wolf, Greenfield & Sacks, P.C.

(57) ABSTRACT

The present technique relates to an acoustic tube and an acoustic reproduction apparatus that can generate an evanescent wave at a lower cost. An acoustic tube includes an acoustic path longer than an external dimension of the acoustic tube and includes a plurality of opening portions or a slit-like opening portion. When a sound wave advances in the acoustic tube, sound waves are output from the plurality of opening portions or from a plurality of positions of the slit-like opening portion, and the sound waves are combined to form an evanescent wave. The present technique can be applied to an acoustic tube, an acoustic reproduction apparatus including the acoustic tube, and the like.

14 Claims, 20 Drawing Sheets

(58) Field of Classification Search
CPC . H04R 1/30; H04R 1/32; H04R 1/323; H04R 1/403
See application file for complete search history.

(56) References Cited

U.S. PATENT DOCUMENTS

| | | | | |
|---|---|---|---|---|
| 2005/0205349 | A1 | 9/2005 | Parker et al. | |
| 2006/0120549 | A1 | 6/2006 | Burghardt | |
| 2007/0080019 | A1 | 4/2007 | Kubota | |
| 2009/0274329 | A1* | 11/2009 | Ickler | G10K 11/26 381/338 |
| 2012/0039475 | A1 | 2/2012 | Berardi et al. | |

FOREIGN PATENT DOCUMENTS

| | | | |
|---|---|---|---|
| CN | 102905206 | A | 1/2013 |
| JP | 5-183979 | A | 7/1993 |
| JP | 2011-520354 | A | 7/2011 |
| JP | 2012-044572 | A | 3/2012 |
| JP | 2013-026715 | A | 2/2013 |
| JP | 2013-538509 | A | 10/2013 |
| JP | 2013-236216 | A | 11/2013 |
| WO | WO 2012/021713 | A1 | 2/2012 |

OTHER PUBLICATIONS

International Search Report and English translation thereof dated May 23, 2017 in connection with International Application No. PCT/JP2017/010867.

Written Opinion and English translation thereof dated May 23, 2017 in connection with International Application No. PCT/JP2017/010867.

International Preliminary Report on Patentability and English translation thereof dated Oct. 11, 2018 in connection with International Application No. PCT/JP2017/010867.

Chinese Office Action dated Aug. 2, 2019 in connection with Chinese Application No. 201780018300.4 and English translation thereof.

Extended European Search Report dated Oct. 1, 2019 in connection with European Application No. 17774427.3.

* cited by examiner

ACOUSTIC TUBE AND ACOUSTIC REPRODUCTION APPARATUS

CROSS-REFERENCE TO RELATED APPLICATIONS

This application claims the benefit under 35 U.S.C. § 371 as a U.S. National Stage Entry of International Application No. PCT/JP2017/010867, filed in the Japanese Patent Office as a Receiving Office on Mar. 17, 2017, which claims priority to Japanese Patent Application Number JP 2016-072168, filed in the Japanese Patent Office on Mar. 31, 2016, each of which is hereby incorporated by reference in its entirety.

TECHNICAL FIELD

The present technique relates to an acoustic tube and an acoustic reproduction apparatus, and particularly, to an acoustic tube and an acoustic reproduction apparatus that can generate an evanescent wave at a lower cost.

BACKGROUND ART

In a place shared by many people, such as a public facility, a technique of providing information only to specific people is significantly useful.

For example, in many cases, the station staff desires to provide different information to a person waiting for an outbound train on a platform of a train and a person waiting for an inbound train. In addition, many people use a bank, and the communication at the reception desk and the like is often related to personal information. Therefore, it is desirable that the communication be not heard from far away.

Thus, a technique called spot reproduction that allows only people in a specific area to hear the reproduced voice is developed and actually used.

For example, a flat speaker, a parametric speaker that modulates an ultrasonic wave to generate sound in an audible range, and the like are used in a platform of a station or the like. The speakers can use high directivity to propagate sound only in a specific direction, and the sound can be delivered only to listeners in a specific direction. However, in the method, the attenuation is small in the specific direction, and the sound is transmitted far away.

In this regard, there is a method in the spot reproduction technique, in which spot reproduction is realized with respect to the distance and the direction from the speaker. This is a method of generating a wave front called an evanescent wave that is significantly quickly attenuated compared to a spherical wave.

The evanescent wave is a wave generated under a condition that the wavelength becomes shorter than the wavelength of a normal propagating wave for some reason. A method based on a combination of a speaker array and signal processing is proposed as a method of generating the evanescent wave (for example, see PTL 1 to PTL 3).

Specifically, for example, in a case of using a linear speaker array to generate an evanescent wave for sound of 1 kHz (wavelength of 34 cm), phase differences can be set stepwise between all speaker units included in the linear speaker array, and the interval of rotation (2Π) of the phase can be set to a length smaller than 34 cm.

CITATION LIST

Patent Literature

[PTL 1]
JP 2013-236216A
[PTL 2]
JP 2013-26715A
[PTL 3]
JP 2012-44572A

SUMMARY

Technical Problem

However, in the case where the speaker array combines the wave fronts to generate the evanescent wave, the required numbers of speakers, amplifiers, and DA (Digital to Analog) converters are equivalent to the number of channels of the array, and the load of the signal processing operation is enormous. Therefore, the implementation is difficult in terms of cost.

Thus, a technique of generating an evanescent wave with fewer speakers and less operation load, that is, at a lower cost, is necessary.

The present technique has been made in view of the circumstances, and the present technique enables to generate an evanescent wave at a lower cost.

Solution to Problem

A first aspect of the present technique provides an acoustic tube including: an acoustic path longer than an external dimension of the acoustic tube; and a plurality of opening portions or a slit-like opening portion.

The plurality of opening portions can be lined up and provided in a predetermined direction.

The plurality of opening portions can be provided such that a distance between the opening portions adjacent to each other is a predetermined distance.

The acoustic path can be shaped such that a speed of a sound wave in a predetermined direction is lower than a speed of the sound wave advancing in the acoustic path.

The acoustic tube can output a sound wave from each of the plurality of opening portions or output a sound wave from each of a plurality of positions of the slit-like opening portion to generate an evanescent wave.

The acoustic tube can be obtained by winding a cylindrical tube to form a spiral shape.

The acoustic tube can be obtained by using a cylindrical tube deformed into a wave shape and shaping the tube into an annular shape.

The acoustic tube can be obtained by providing a partition inside.

According to the first aspect of the present technique, the acoustic tube includes the acoustic path longer than the external dimension of the acoustic tube, and the plurality of opening portions or the slit-like opening portion.

A second aspect of the present technique provides an acoustic reproduction apparatus including: an acoustic tube including an acoustic path longer than an external dimension of the acoustic tube and including a plurality of opening portions or a slit-like opening portion; and a speaker that outputs a sound wave into the acoustic tube.

The acoustic path can be shaped such that a speed of the sound wave in a predetermined direction is lower than a speed of the sound wave advancing in the acoustic path.

The acoustic tube can output the sound wave from each of the plurality of opening portions or output the sound wave from each of a plurality of positions of the slit-like opening portion to generate an evanescent wave.

The acoustic reproduction apparatus can include a plurality of speakers that output sound waves into the acoustic tube.

The acoustic reproduction apparatus can further include an acoustic correction unit that applies acoustic correction to an acoustic signal to be supplied to the speaker.

The acoustic reproduction apparatus can include a plurality of acoustic tubes and a plurality of speakers.

The acoustic reproduction apparatus can further include a bandwidth dividing unit that divides a bandwidth of an acoustic signal to generate each of a plurality of acoustic signals to be output to each of the plurality of speakers.

The plurality of acoustic tubes can include the acoustic tubes, each having a different ratio of a first distance in a predetermined direction to a second distance of advance of the sound wave advancing in the acoustic path while the sound wave advances in the predetermined direction by the first distance.

According to the second aspect of the present technique, the speaker outputs the sound wave into the acoustic tube including the acoustic path longer than the external dimension of the acoustic tube and including the plurality of opening portions or the slit-like opening portion.

Advantageous Effect of Invention

According to the first aspect and the second aspect of the present technique, the evanescent wave can be generated at a lower cost.

Note that the advantageous effect described here may not be limited, and the advantageous effect may be any of the advantageous effects described in the present disclosure.

DESCRIPTION OF EMBODIMENTS

Figure 1:
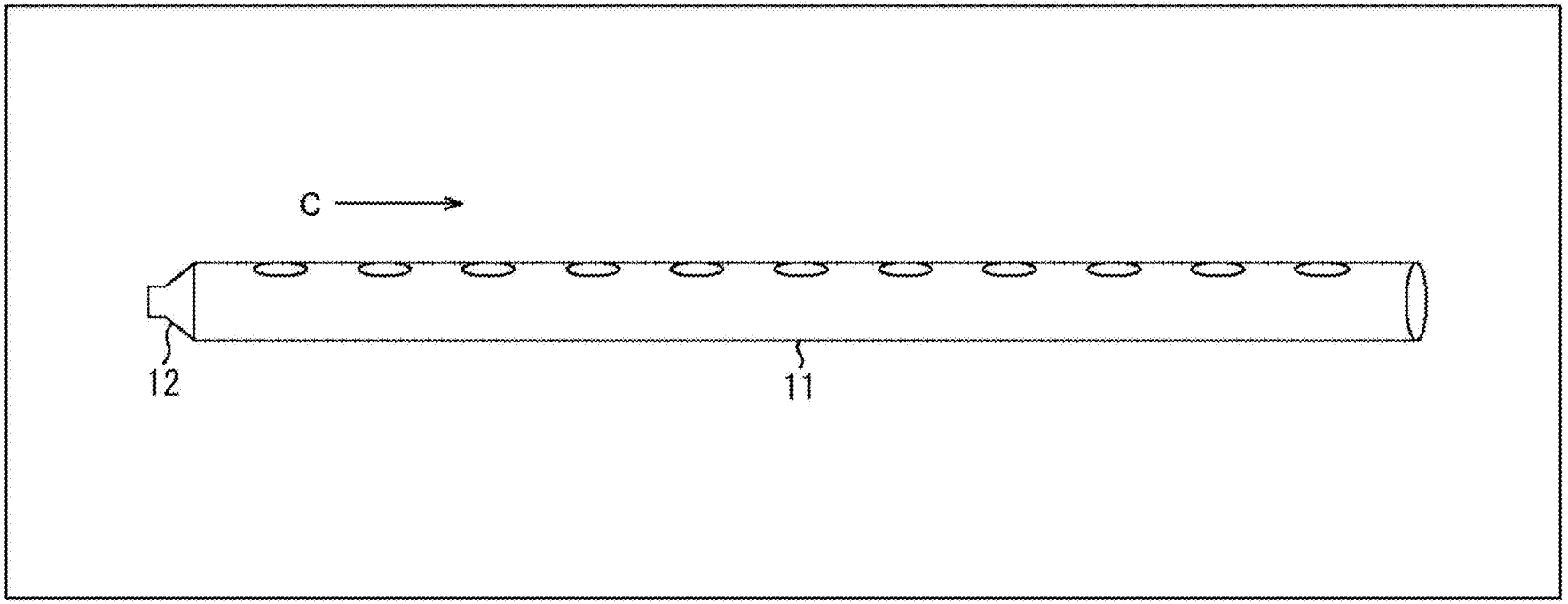
FIG. 1 a diagram describing an end-fire array.

Hereinafter, embodiments according to the present technique will be described with reference to the drawings.

First Embodiment

<Present Technique>

In the present technique, an attenuation rate of an evanescent wave is taken into account to determine the shape of an acoustic tube, and spot reproduction can be realized by using a single speaker. Note that the present technique can be applied not only to the spot reproduction, but also to various other applications.

(Derivation of Plane Wave and Evanescent Wave Using Wave Equation)

The propagation of sound is described by a wave equation, and the wave equation will be used to describe the evanescent wave. First, the wave equation of a free space is represented by the following Formula (1).

[Math. 1]

$$\nabla^2 p(x_v, t) - \frac{1}{c^2}\frac{\partial^2 p(x_v, t)}{\partial t^2} = 0 \tag{1}$$

Note that in Formula (1), t denotes time, and $x_v$ indicates coordinates of a two-dimensional space, that is, a position on the two-dimensional space. Particularly, the position $x_v$ here is represented by an x-coordinate and a y-coordinate. In addition, $p(x_v,t)$ denotes sound pressure of the position $x_v$ at the time t, and c denotes speed of sound. Furthermore, $\nabla^2$ in Formula (1) represents a second-order partial differential as indicated in the following Formula (2).

[Math. 2]

$$\nabla^2 = \frac{\partial^2}{\partial^2 x} + \frac{\partial^2}{\partial^2 y} \tag{2}$$

In addition, variables of the sound pressure $p(x_v,t)$ can be separated into a function $X(x_v)$ regarding the position $x_v$ and a function T(t) regarding the time t, and the sound pressure $p(x_v,t)$ can be represented by the following Formula (3).

[Math. 3]

$$p(x_v,t)=X(x_v)T(t) \tag{3}$$

Here, a Fourier transform $T_F(\lambda)$ of the function T(t) is as indicated in the following Formula (4), where ω is an angular frequency, and i is an imaginary number.

[Math. 4]

$$F\{T(t)\} = T_F(\omega) = \frac{1}{2\pi}\int_{-\infty}^{\infty} T(t)e^{-i\omega t}dt \tag{4}$$

In addition, an inverse Fourier transform T(t) of $T_F(\omega)$ is as indicated in the following Formula (5).

[Math. 5]

$$T(t)=\int_{-\infty}^{\infty} T_F(\omega)e^{i\omega t}d\omega \tag{5}$$

Furthermore, a second-order partial derivative of the inverse Fourier transform T(t) is represented by the following Formula (6), and a Fourier transform of the second-order partial derivative is as indicated in the following Formula (7).

[Math. 6]

$$\frac{\partial^2 T(t)}{\partial t^2} = \int_{-\infty}^{\infty} (i\omega)^2 T_F(\omega)e^{i\omega t}d\omega \tag{6}$$

[Math. 7]

$$F\left(\frac{\partial^2 T(t)}{\partial t^2}\right) = (i\omega)^2 T_F(\omega) \tag{7}$$

Now, a Fourier transform $P(x_v,\omega)$ of the sound pressure $p(x_v,t)$ is as indicated by the following Formula (8) on the basis of Formula (3), and a solution indicated in the following Formula (9) is derived as a general solution of the wave equation of Formula (1).

[Math. 8]

$$P(x_v, \omega) = X(x_v)T_F(\omega) \tag{8}$$

[Math. 9]

$$\nabla^2 P(x_v, \omega) + \left(\frac{\omega}{c}\right)^2 P(x_v, \omega) = 0 \tag{9}$$

$$P(x_v, \omega) = A(\omega)e^{-ik_v \cdot x_v}$$

Note that in Formula (9), A(ω) is an arbitrary function with an angular frequency co as a variable, and i denotes an imaginary number. In addition, $x_v$ and $k_v$ in Formula (9) denote a vector indicating the position on the two-dimensional space, that is, xy-coordinate system, and a vector of the wave number, respectively, and $x_v$ and $k_v$ are represented by the following Formula (10) and Formula (11), respectively.

[Math. 10]

$$X_v=xv_i+yv_j \tag{10}$$

[Math. 11]

$$k_v=k_xv_i+k_yv_j \tag{11}$$

Note that in Formula (10) and Formula (11), $v_i$ and $v_j$ represent a unit vector in the x direction and a unit vector in the y direction in the xy coordinate system, respectively. In addition, x and y in Formula (10) denote the x-coordinate and the y-coordinate in the xy-coordinate system, and $k_x$ and $k_y$ in Formula (11) indicate the wave number in the x direction and the wave number in the y direction, respectively.

Hereinafter, the position vector $x_v$ will also be simply referred to as a position $x_v$, and the wave number vector $k_v$ will also be simply referred to as a wave number $k_v$. Particularly, the wave number $k_v$ is a spatial frequency represented by 2Π/λ where λ is a wavelength of sound.

In addition, an inner product of the position $x_v$ and the wave number $k_v$ is as indicated in the following Formula (12), and an absolute value of the wave number $k_v$ and a square value of the absolute value of the wave number $k_v$ are as indicated in the following Formula (13) and Formula (14), respectively.

[Math. 12]

$$k_v \cdot x_v = k_x x + k_y y \tag{12}$$

[Math. 13]

$$|k_v| = \frac{\omega}{c} \tag{13}$$

[Math. 14]

$$|k_v|^2 = \left(\frac{\omega}{c}\right)^2 = k_x^2 + k_y^2 \tag{14}$$

Here, when the absolute value of the wave number $k_v$ is equal to or greater than the absolute value of the wave number $k_x$ in the x direction, that is, when the following Formula (15) holds, the wave number $k_y$ in the y direction is as indicated in the following Formula (16) on the basis of Formula (14). Therefore, in this case, the sound wave represented by the sound pressure $P(x_v,\omega)$ obtained in Formula (9) is a plane wave.

[Math. 15]

$$\left|\frac{\omega}{c}\right| \geq |k_x| \tag{15}$$

[Math. 16]

$$k_y = \pm\sqrt{\left(\frac{\omega}{c}\right)^2 - k_x^2} \tag{16}$$

On the other hand, when the absolute value of the wave number $k_v$ is smaller than the absolute value of the wave number $k_x$ in the x direction, that is, when the following Formula (17) holds, the wave number $k_y$ in the y direction is as indicated by the following Formula (18).

[Math. 17]

$$|k_x| > \left|\frac{\omega}{c}\right| \tag{17}$$

[Math. 18]

$$k_y = \pm i\sqrt{k_x^2 - \left(\frac{\omega}{c}\right)^2} \tag{18}$$

Note that i in Formula (18) denotes an imaginary number. In this way, the wave number $k_y$ in the y direction is an imaginary number in the case where the condition of Formula (17) holds.

The following Formula (19) is obtained by assigning the wave number $k_y$ indicated in Formula (18) to the sound pressure $P(x_v,\omega)$ of Formula (9).

[Math. 19]

$$P(x_v, \omega) = A(\omega)e^{-\sqrt{k_x^2-\left(\frac{\omega}{c}\right)^2}\,y}e^{-ik_x x} \tag{19}$$

It can be recognized that a wave front with the wave number of $k_x$ appears in the x direction of the sound pressure $P(x_v,\omega)$ indicated by Formula (19), and a sound field with exponentially attenuating sound pressure is obtained in the y direction of the sound pressure $P(x_v,\omega)$. Such a sound wave is the evanescent wave.

Note that the sound pressure $P(x_v,\omega)$ where $y>0$ is physically meaningful only in a case where the wave number $k_y$ is as in the following Formula (20), and the wave number $k_y$ indicated in Formula (20) is assigned in the calculation of obtaining Formula (19).

[Math. 20]

$$k_y = -i\sqrt{k_x^2 - \left(\frac{\omega}{c}\right)^2} \tag{20}$$

(End-Fire Array)

By the way, an elongated cylindrical tube 11 as illustrated for example in FIG. 1 will be considered. In FIG. 1, a speaker 12 is installed on the left end of the cylindrical tube 11, and a plurality of openings are provided on an upper part of the cylindrical tube 11.

Note that in FIG. 1, the horizontal direction in FIG. 1 will be referred to as an x direction, and the direction perpendicular to the x direction will be referred to as a y direction. The x direction and the y direction correspond to the x direction and the y direction of the position vector $x_v$ indicated in Formula (10). In the example illustrated in FIG. 1, a plurality of openings are lined up in the x direction on the upper surface of the cylindrical tube 11.

For example, when the speaker 12 emits sound with the angular frequency ω, the sound wave propagates in the x direction at the speed of sound c in the cylindrical tube 11.

In this case, the wave number $k_x$ in the x direction in the cylindrical tube 11 is as indicated in the following Formula (21).

[Math. 21]

$$k_x = \frac{\omega}{c} \tag{21}$$

Once the sound emitted from the speaker 12 reaches the openings provided on the cylindrical tube 11, the sound propagated in the cylindrical tube 11 is also output to the outside of the cylindrical tube 11 through the openings. The wave number $k_x$ in the x direction of the sound output to the outside of the cylindrical tube 11 remains the same as in the case indicated in Formula (21), that is, the same as the wave number $k_x$ in the cylindrical tube 11, as indicated in the following Formula (22).

[Math. 22]

$$k_x = \frac{\omega}{c} \tag{22}$$

Therefore, Formula (15) holds in this case, and the plane wave appears on the outside of the cylindrical tube 11. In addition, the wave number $k_y$ in the y direction at this point is 0 as indicated in the following Formula (23), and it can be recognized that the direction of the plane wave appearing on the outside of the cylindrical tube 11 is equal to the x direction.

[Math. 23]

$$k_y = \pm\sqrt{\left(\frac{\omega}{c}\right)^2 - k_x^2} = 0 \tag{23}$$

Such an array of openings is called an end-fire array, and the array is actually applied to a shotgun microphone and the like.

(Present Technique)

On the other hand, in the present technique, an apparent speed of sound c' as viewed from the outside of the acoustic tube that propagates sound is slower than the actual speed of sound c, and the evanescent wave is output from the acoustic tube. More specifically, the evanescent wave is generated outside of the acoustic tube.

Here, the speed of sound c' is a speed of sound advancing in the acoustic tube in a direction from an input end of the acoustic tube receiving the sound to a trailing end of the acoustic tube. That is, the speed of sound c' is a speed in the direction of advance of the sound in a large sense. In addition, the direction from the input end of the acoustic tube to the trailing end of the acoustic tube is the x direction here, and the direction perpendicular to the x direction is the y direction. The x direction and the y direction correspond to the x direction and the y direction of the position vector $x_v$ indicated in Formula (10).

To control the speed of sound c' to generate the evanescent wave attenuated in the y direction, a condition indicated in the following Formula (24) is a necessary and sufficient condition for the wave number $k_x$ in the x direction. That is, Formula (24) has to hold.

[Math. 24]

$$|k_x| > \left|\frac{\omega}{c}\right| \tag{24}$$

To satisfy Formula (24), a path of sound advancing in the acoustic tube, that is, an acoustic path of the acoustic tube, can be deformed to slow down the apparent speed of sound c' as viewed from the outside of the acoustic tube.

Figure 2:
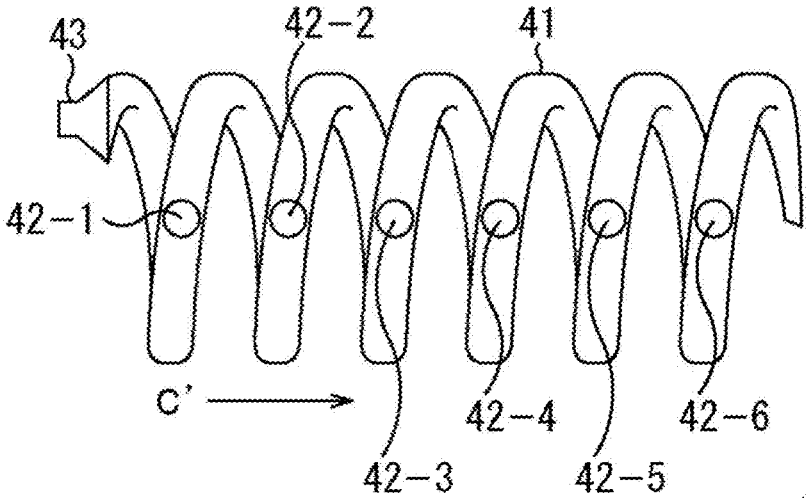
FIG. 2 is a diagram illustrating a configuration example of an acoustic tube according to the present technique.

Specifically, as illustrated for example in FIG. 2, the tube in a cylindrical shape is deformed into a spiral shape to prevent the sound from advancing linearly.

FIG. 2 is a diagram illustrating a configuration example of an embodiment of the acoustic tube according to the present technique. In the example, an acoustic tube 41 has a shape in which a hollow cylindrical tube is wound to form a spiral shape. Therefore, the external dimension of the acoustic tube 41 is shorter than the acoustic path of the acoustic tube 41.

Specifically, the left end of the acoustic tube 41 in FIG. 2 is the input end of sound, and the right end of the acoustic tube 41 in FIG. 2 is the trailing end where the sound reaches. The distance in the horizontal direction of FIG. 2 from the input end to the trailing end is the external dimension of the acoustic tube 41. In addition, assuming that the acoustic path is a path of the sound wave from the input end to the trailing end in the acoustic tube 41 when the sound wave is input from the input end of the acoustic tube 41, the external dimension of the acoustic tube 41 is smaller than the length of the acoustic path. In other words, the acoustic tube 41 includes an acoustic path longer than the external dimension of the acoustic tube 41.

Here, the direction from the input end to the trailing end of the acoustic tube 41, that is, the horizontal direction in FIG. 2, is the x direction, and the direction perpendicular to the x direction is the y direction.

Furthermore, in the example, openings 42-1 to 42-6 as a plurality of opening portions that output (emit) sound are lined up and provided in the x direction on the near side of the tube in FIG. 2 configuring the acoustic tube 41. Note that the openings 42-1 to 42-6 will also be simply referred to as openings 42 in a case where the distinction is not particularly necessary.

The openings 42 are through holes that connect the inside of the acoustic tube 41, that is, the acoustic path, and the outside of the acoustic tube 41. Therefore, the openings 42 function as opening portions provided on the acoustic path and configured to emit the sound wave advancing in the acoustic path to the outside at a timing that the sound wave passes through the openings 42.

Note that the shape and the positions of the openings 42 provided on the acoustic tube 41, the number of openings 42, and the intervals between the openings 42 are not particularly limited. That is, the shape of the openings 42 is not limited to the circular shape, and the shape can be any shape such as a slit shape. The positions of the openings 42 provided on the acoustic tube 41 can also be arbitrary positions. In addition, the number of openings 42 may also be any number, and the distance between the openings 42 adjacent to each other can also be an arbitrary distance. For example, although the openings 42 are equally spaced and lined up in the x direction in FIG. 2, the openings 42 may be unequally spaced and lined up.

However, if the intervals between the openings 42 are too wide, sound with a high frequency cannot be reproduced in the evanescent wave, and it is preferable to provide the openings 42 at moderately close intervals.

Furthermore, although the plurality of openings 42 are provided on the acoustic tube 41 here, a slit may be provided along the tube configuring the acoustic tube 41 from the input end to the trailing end of the acoustic tube 41, for example. That is, it is only necessary that the sound be emitted from a plurality of parts other than the trailing end in the tube configuring the acoustic tube 41.

In addition, a speaker 43 is arranged on the left end, that is, the input end, of the acoustic tube 41 in FIG. 2. Therefore, when the speaker 43 outputs sound, the sound passes through the acoustic tube 41, that is, the acoustic path of the acoustic tube 41, and reaches the trailing end of the acoustic tube 41.

In this case, the sound is emitted to the outside from the openings 42 at the timing that the sound emitted from the speaker 43 reaches the openings 42 positioned on the acoustic path of the acoustic tube 41.

That is, the sound emitted from the speaker 43 advances in the acoustic tube 41, that is, in the acoustic path of the acoustic tube 41, and reaches the opening 42-1 first. Consequently, the sound is emitted to the outside from the opening 42-1, and the sound emitted from the speaker 43 further advances in the acoustic tube 41.

Then, until the sound emitted from the speaker 43 reaches the trailing end, the sound is emitted from the opening 42 every time the sound reaches the opening 42 on the acoustic path. In this way, when the sound is output from the speaker 43, the sound is sequentially emitted from the openings 42 from the opening 42-1 to the opening 42-6, and the sound emitted from the openings 42, that is, sound waves, is combined outside of the acoustic tube 41.

A cylindrical tube, such as the acoustic tube 41, is deformed into a shape different from a linear shape, to prevent the sound wave from reaching the trailing end at the shortest distance from the input end. That is, the acoustic path of the acoustic tube 41 is deformed into a path in a shape different from a linear shape to prevent the sound wave advancing in the acoustic tube 41 from going straight in the x direction to the trailing end. In this way, the speed of sound c' in the x direction can be lower than the speed of sound c.

In this case, the speed of the sound wave advancing in the acoustic tube 41 is c, and a wave number $k_c$ in the traveling direction of the sound wave in the acoustic tube 41 is obtained by dividing the angular frequency ω of the sound by the speed of sound c as indicated in the following Formula (25).

[Math. 25]

$$k_c = \frac{\omega}{c} \tag{25}$$

Here, it is assumed that the length of the path of the sound wave advancing to the trailing end in the acoustic tube 41, that is, the length of the acoustic path of the acoustic tube 41, is m times (where m>1) the distance of the sound wave advancing in the x direction, that is, the distance (direct distance) in the x direction from the input end to the trailing end of the acoustic tube 41. In other words, it is assumed that the length of the acoustic path of the acoustic tube 41 is m times the external dimension of the acoustic tube 41.

Hereinafter, m that is a ratio of the length of the actual acoustic path to the distance in the x direction from the input end to the trailing end will also be referred to as a compression ratio m of the acoustic path.

The compression ratio m can be referred to as a ratio of a first distance to a second distance, where the first distance is a distance of the sound wave advancing in the x direction in the acoustic tube 41, and the second distance is a distance of the sound wave advancing in the acoustic path of the acoustic tube 41 while the sound wave advances by the first distance in the x direction.

In the case where the compression ratio of the acoustic path of the acoustic tube 41 is m to 1, the relationship between the wave number $k_c$ of the sound wave in the acoustic tube 41 and the wave number $k_x$ in the x direction of the sound wave outside of the acoustic tube 41 is as indicated in the following Formula (26).

[Math. 26]

$$|k_x| = m|k_c| = m\left|\frac{\omega}{c}\right| > \left|\frac{\omega}{c}\right| \tag{26}$$

The absolute value of the wave number $k_x$ is greater than the absolute value of the wave number $k_c$ in Formula (26), that is, the condition indicated in Formula (24) is satisfied, and it can be recognized that the evanescent wave is formed by combining the sound waves emitted from the openings 42. That is, it can be recognized that the evanescent wave is generated by the acoustic tube 41.

In this case, the wave number $k_y$ in the y direction of the sound wave outside of the acoustic tube 41 is as indicated in the following Formula (27).

[Math. 27]

$$k_y = \pm i\sqrt{k_x^2 - \left(\frac{\omega}{c}\right)^2} = \pm i\frac{\omega}{c}\sqrt{m^2 - 1} \tag{27}$$

Looking from a different perspective, when the wave front of the sound propagating through the acoustic path in the acoustic tube 41 is viewed from the outside of the acoustic tube 41, the speed of sound c' that is an apparent speed of the sound in the x direction is as indicated in the following Formula (28), and it can be recognized that the speed of sound c' is lower than the speed of sound c.

[Math. 28]

$$c' = \frac{c}{m} < c \tag{28}$$

Therefore, the following Formula (29) holds regarding the wave number $k_x$, and it can be recognized that the sound waves emitted from the acoustic tube 41 are combined to form an evanescent wave.

[Math. 29]

$$|k_x| = \left|\frac{\omega}{c'}\right| > \left|\frac{\omega}{c}\right| \tag{29}$$

The x direction is a traveling direction of the sound wave in the acoustic tube 41 in a large sense. As described with reference to Formula (28) and Formula (29), when the speed c' in the x direction of the sound wave in the acoustic tube 41 is lower than the speed of sound c of the sound wave advancing in the acoustic path of the acoustic tube 41, the sound waves output to the outside of the acoustic tube 41 are combined to form an evanescent wave. Therefore, the shape of the acoustic path of the acoustic tube 41 can be any shape as long as the shape satisfies the condition indicated in Formula (28). In other words, the acoustic tube 41 can be any tube as long as the acoustic tube 41 has an acoustic path longer than the external dimension.

<Configuration Example of Acoustic Reproduction Apparatus>

Next, an acoustic reproduction apparatus using the acoustic tube according to the present technique described above will be described. Such an acoustic reproduction apparatus is configured as illustrated for example in FIG. 3. Note that in FIG. 3, the same reference signs are provided to the parts corresponding to the case of FIG. 2, and the description will be appropriately skipped.

Figure 3:
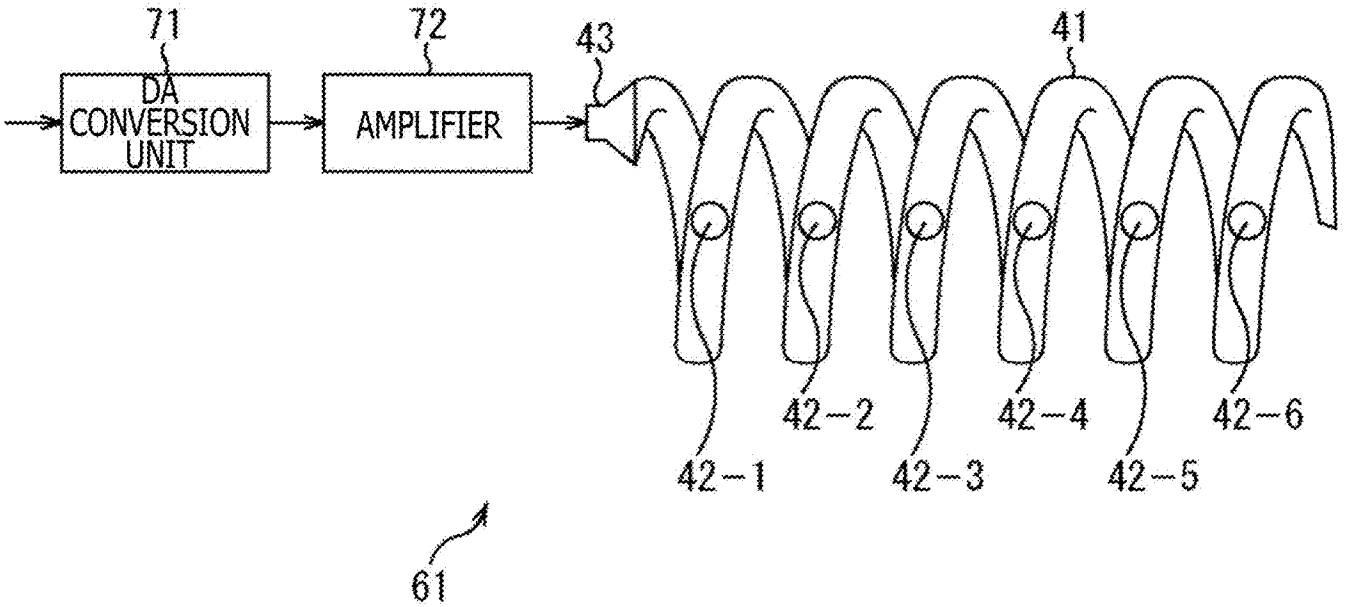
FIG. 3 is a diagram illustrating a configuration example of an acoustic reproduction apparatus according to the present technique.

An acoustic reproduction apparatus 61 illustrated in FIG. 3 includes the spiral acoustic tube 41 and functions as an evanescent wave generation apparatus. The acoustic reproduction apparatus 61 includes a DA (Digital Analog) conversion unit 71, an amplifier 72, the speaker 43, and the acoustic tube 41.

In the acoustic reproduction apparatus 61, the input end of the acoustic tube 41 illustrated in FIG. 2 is connected to the speaker 43 that outputs sound. Furthermore, in the acoustic reproduction apparatus 61, an acoustic signal of the sound to be reproduced is supplied to the DA conversion unit 71.

The DA conversion unit 71 converts an acoustic signal supplied from the outside from a digital signal to an analog signal and supplies the signal to the amplifier 72. The amplifier 72 amplifies the analog acoustic signal supplied from the DA conversion unit 71 and supplies the signal to the speaker 43.

The speaker 43 reproduces sound on the basis of the acoustic signal supplied from the amplifier 72. That is, the speaker 43 outputs a sound wave on the basis of the acoustic signal into the acoustic tube 41.

The sound wave output from the speaker 43 in this way is input to the acoustic tube 41 from the input end of the acoustic tube 41 attached to the speaker 43 and propagated to the trailing end through the acoustic path of the acoustic tube 41. In this case, when the sound wave advancing in the acoustic tube 41 reaches the opening 42, a sound wave that is a spherical wave is emitted from the opening 42, and the sound waves emitted from the openings 42 are combined to form an evanescent wave.

The sound based on the acoustic signal is reproduced by the evanescent wave, and a person near the acoustic tube 41 can hear the sound. On the other hand, a person at a position far from the acoustic tube 41 can hardly hear the sound reproduced by the acoustic reproduction apparatus 61.

In this way, the acoustic reproduction apparatus 61 including the acoustic tube 41 can reproduce the sound to realize spot reproduction. Moreover, just the acoustic tube 41 physically deformed to compress the acoustic path to the ratio of m to 1 needs to be used in the acoustic reproduction apparatus 61, and the evanescent wave can be simply generated at a low cost. That is, the evanescent wave can be generated without providing a plurality of speakers, amplifiers, and DA conversion units.

In the acoustic tube 41, a cylindrical tube is deformed into a spiral shape, and the path of the sound wave in the x direction is m times the path before the deformation. The extension ratio of the path of the sound wave is expressed by the compression ratio m.

Note that the trailing end of the acoustic tube 41 may be open, that is, an open end, or may be sealed, that is, a closed end. Particularly, in the case where the trailing end of the acoustic tube 41 is sealed, a sound absorbing material can be used to seal the trailing end to prevent reflection of sound at the trailing end.

In addition, although the speaker 43 is connected to the input end of the acoustic tube 41 in the example illustrated in FIG. 3, an already existing object that produces sound may be attached to the input end of the acoustic tube 41 without providing the speaker 43 on the input end of the acoustic tube 41. In other words, the sound input from the input end of the acoustic tube 41 is not limited to the sound output from the speaker 43, and the sound may be emitted from any other sound sources.

Modification 1 of First Embodiment

<Configuration Example of Acoustic Tube>

In addition, the acoustic tube according to the present technique is not limited to the example illustrated in FIG. 2, and any acoustic tube can be used as long as the external dimension is smaller than the length of the acoustic path, and the acoustic tube includes an opening section that emits sound waves to the outside from two or more parts. Hereinafter, other configuration examples of the acoustic tube will be described with reference to FIGS. 4 to 11. Note that in FIGS. 4 to 11, the same reference signs are provided to the parts corresponding to the case of FIG. 3, and the description will be appropriately skipped.

Figure 4:
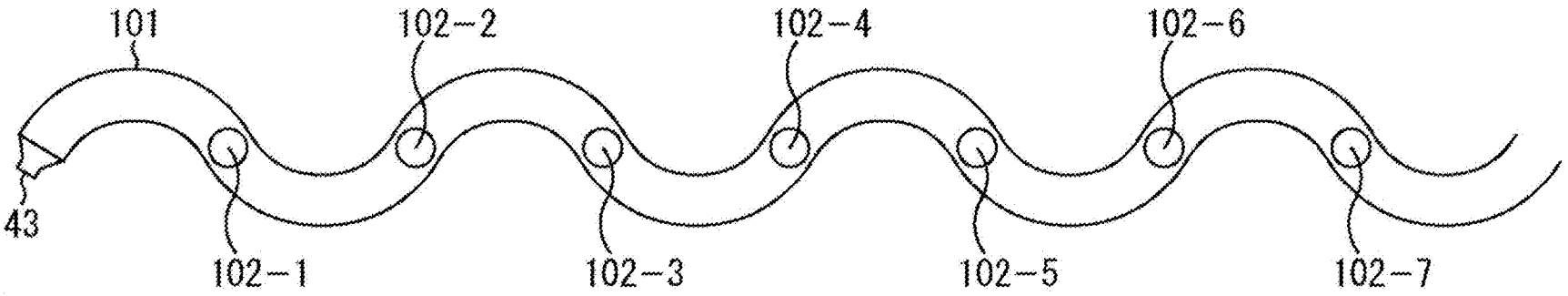
FIG. 4 is a diagram illustrating another configuration example of the acoustic tube.

In an example illustrated in FIG. 4, an acoustic tube 101 is obtained by deforming a hollow cylindrical tube into a wave shape, and circular openings 102-1 to 102-7 linearly lined up in the horizontal direction in FIG. 4 are formed on the near side of the acoustic tube 101 in FIG. 4.

In addition, a left end of the acoustic tube 101 in FIG. 4 is an input end, and the speaker 43 is connected to the input end. In addition, an end on the right side of the acoustic tube 101 in FIG. 4 is a trailing end, and the trailing end is open in the example.

The length in the horizontal direction of FIG. 4 from the input end to the trailing end of the acoustic tube 101, that is, the external dimension of the acoustic tube 101, is smaller than the length of an acoustic path of the acoustic tube 101, and the evanescent wave can be generated.

In the acoustic tube 101, when a sound wave is output from the speaker 43, the sound wave is sequentially emitted from each of the openings 102-1 to 102-7 until the sound wave reaches the trailing end of the acoustic tube 101, and the wave obtained by combining the sound waves is an evanescent wave.

Modification 2 of First Embodiment

<Configuration Example of Acoustic Tube>

Figure 5:
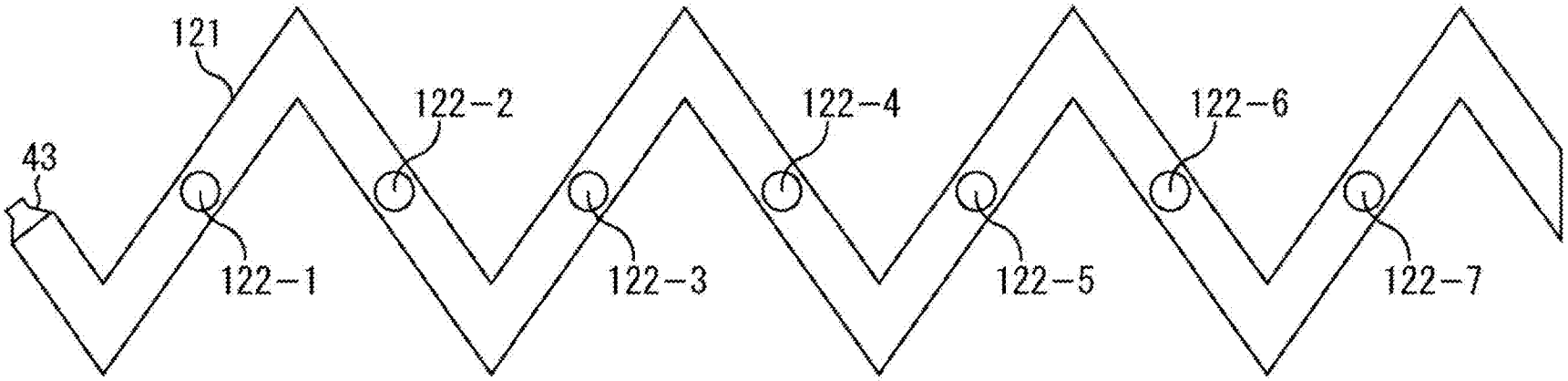
FIG. 5 is a diagram illustrating another configuration example of the acoustic tube.

Furthermore, in an example illustrated in FIG. 5, an acoustic tube 121 is obtained by deforming a hollow cylindrical tube into a mountain shape, and circular openings 122-1 to 122-7 linearly lined up in the horizontal direction in FIG. 5 are formed on the near side of the acoustic tube 121 in FIG. 5.

In addition, a left end of the acoustic tube 121 in FIG. 5 is an input end, and the speaker 43 is connected to the input end. In addition, an end on the right side of the acoustic tube 121 in FIG. 5 is a trailing end, and the trailing end is closed, that is, sealed, in the example.

In the acoustic tube 121, the length in the horizontal direction of FIG. 5 from the input end to the trailing end, that is, the external dimension of the acoustic tube 121, is also smaller than the length of an acoustic path of the acoustic tube 121. Therefore, when a sound wave is output from the speaker 43, the sound wave is sequentially emitted from each of the openings 122-1 to 122-7 until the sound wave reaches the trailing end of the acoustic tube 121, and the sound waves are combined to form an evanescent wave.

Modification 3 of First Embodiment

<Configuration Example of Acoustic Tube>

Figure 6:
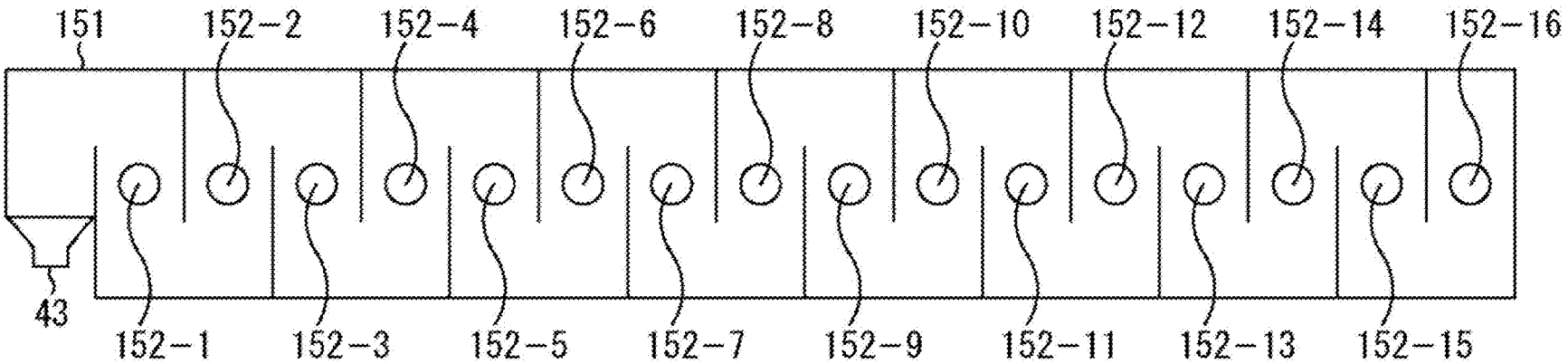
FIG. 6 is a diagram illustrating another configuration example of the acoustic tube.

In an example illustrated in FIG. 6, although an acoustic tube 151 is a cylindrical tube in appearance, partitions are provided inside of the acoustic tube 151, and an acoustic path is not linear. Note that a cross section of the acoustic tube 151 is illustrated in FIG. 6.

In the example, partitions perpendicular to the inner wall of the acoustic tube 151 are formed inside of the acoustic tube 151. In addition, a lower left end of the acoustic tube 151 in FIG. 6 is an input end, and the speaker 43 is connected to the input end. On the other hand, an upper right end of the acoustic tube 151 in FIG. 5 is a trailing end, and the trailing end is closed in the example. Furthermore, circular openings 152-1 to 152-16 linearly lined up in the horizontal direction of FIG. 6 are formed on the acoustic tube 151.

In this way, the partitions are formed inside of the acoustic tube 151, and an acoustic path of the acoustic tube 151 is elongated by the partitions. In the acoustic tube 151, a sound wave output from the speaker 43 goes around the partitions inside of the acoustic tube 151 and advances to the trailing end of the acoustic tube 151. In other words, the acoustic path inside of the acoustic tube 151 is not linear, and the sound wave input from the input end does not go straight.

In the acoustic tube 151, the length in the horizontal direction in FIG. 6 from the input end to the trailing end, that is, the external dimension of the acoustic tube 151, is smaller than the length of the acoustic path of the acoustic tube 151. Therefore, when a sound wave is output from the speaker 43, the sound wave is sequentially emitted from each of the openings 152-1 to 152-16 until the sound wave reaches the trailing end of the acoustic tube 151, and the sound waves are combined to form an evanescent wave.

Modification 4 of First Embodiment

<Configuration Example of Acoustic Tube>

Figure 7:
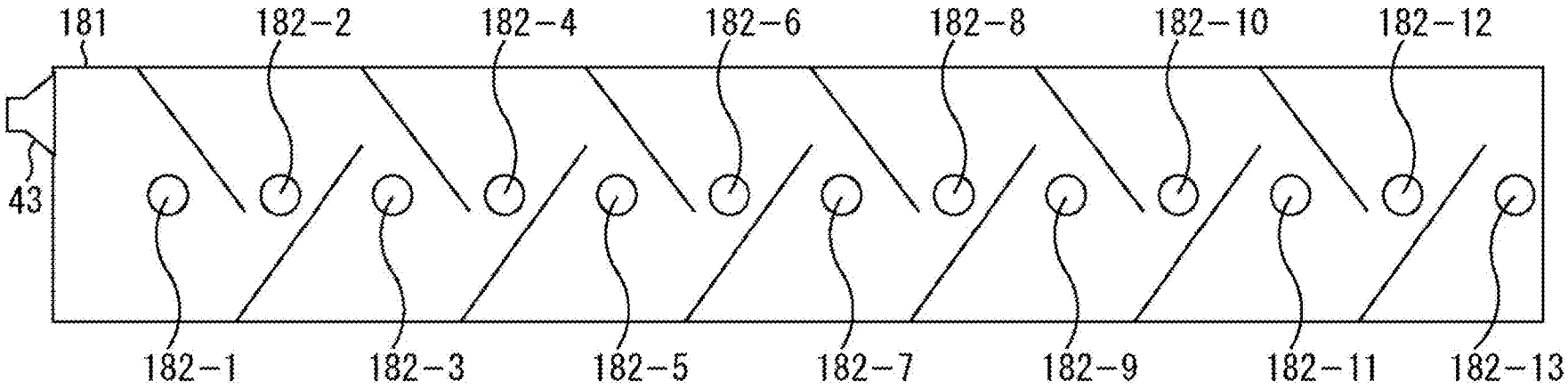
FIG. 7 is a diagram illustrating another configuration example of the acoustic tube.

In an example illustrated in FIG. 7, although an acoustic tube 181 is cylindrical in appearance, partitions are provided inside of the acoustic tube 181 as in the example of FIG. 6. Note that a cross section of the acoustic tube 181 is illustrated in FIG. 7.

In the example, partitions are formed to protrude in an oblique direction with respect to the inner wall of the acoustic tube 181. In addition, an upper left end of the acoustic tube 181 in FIG. 7 is an input end, and the speaker 43 is connected to the input end. On the other hand, a lower right end of the acoustic tube 181 in FIG. 7 is a trailing end, and the trailing end is closed in the example. Furthermore, circular openings 182-1 to 182-13 linearly lined up in the horizontal direction in FIG. 7 are formed on the acoustic tube 181.

In this way, the partitions are formed inside of the acoustic tube 181, and an acoustic path of the acoustic tube 181 is elongated by the partitions. That is, in the acoustic tube 181, the sound wave output from the speaker 43 goes around the partitions inside of the acoustic tube 181 and advances to the trailing end of the acoustic tube 181.

In the acoustic tube 181, the length in the horizontal direction in FIG. 7 from the input end to the trailing end, that is, the external dimension of the acoustic tube 181, is also smaller than the length of the acoustic path of the acoustic tube 181. Therefore, when a sound wave is output from the speaker 43, the sound wave is sequentially emitted from each of the openings 182-1 to 182-13 until the sound wave reaches the trailing end of the acoustic tube 181, and the sound waves are combined to form an evanescent wave.

Modification 5 of First Embodiment

<Configuration Example of Acoustic Tube>

Figure 8:
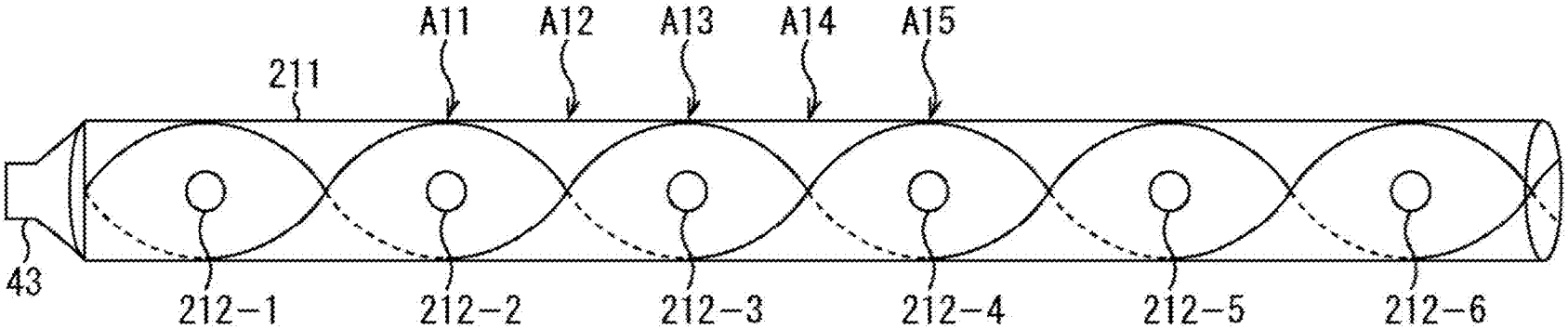
FIG. 8 is a diagram illustrating another configuration example of the acoustic tube.

In an example illustrated in FIG. 8, although an acoustic tube 211 is cylindrical in appearance, a partition is provided inside of the acoustic tube 211.

An end on the left side of the acoustic tube 211 in FIG. 8 is an input end, and the speaker 43 is connected to the input end. On the other hand, an end on the right side of the acoustic tube 211 in FIG. 8 is a trailing end, and the trailing end is open in the example. Furthermore, circular openings 212-1 to 212-6 linearly lined up in the horizontal direction of FIG. 8 are formed on the acoustic tube 211.

In addition, the partition provided inside of the acoustic tube 211 is a partition separating a circle that is the cross section of the acoustic tube 211 into two spaces, and the partition seems to rotate when the cross-sectional position is moved in the horizontal direction in FIG. 8.

Figure 9:
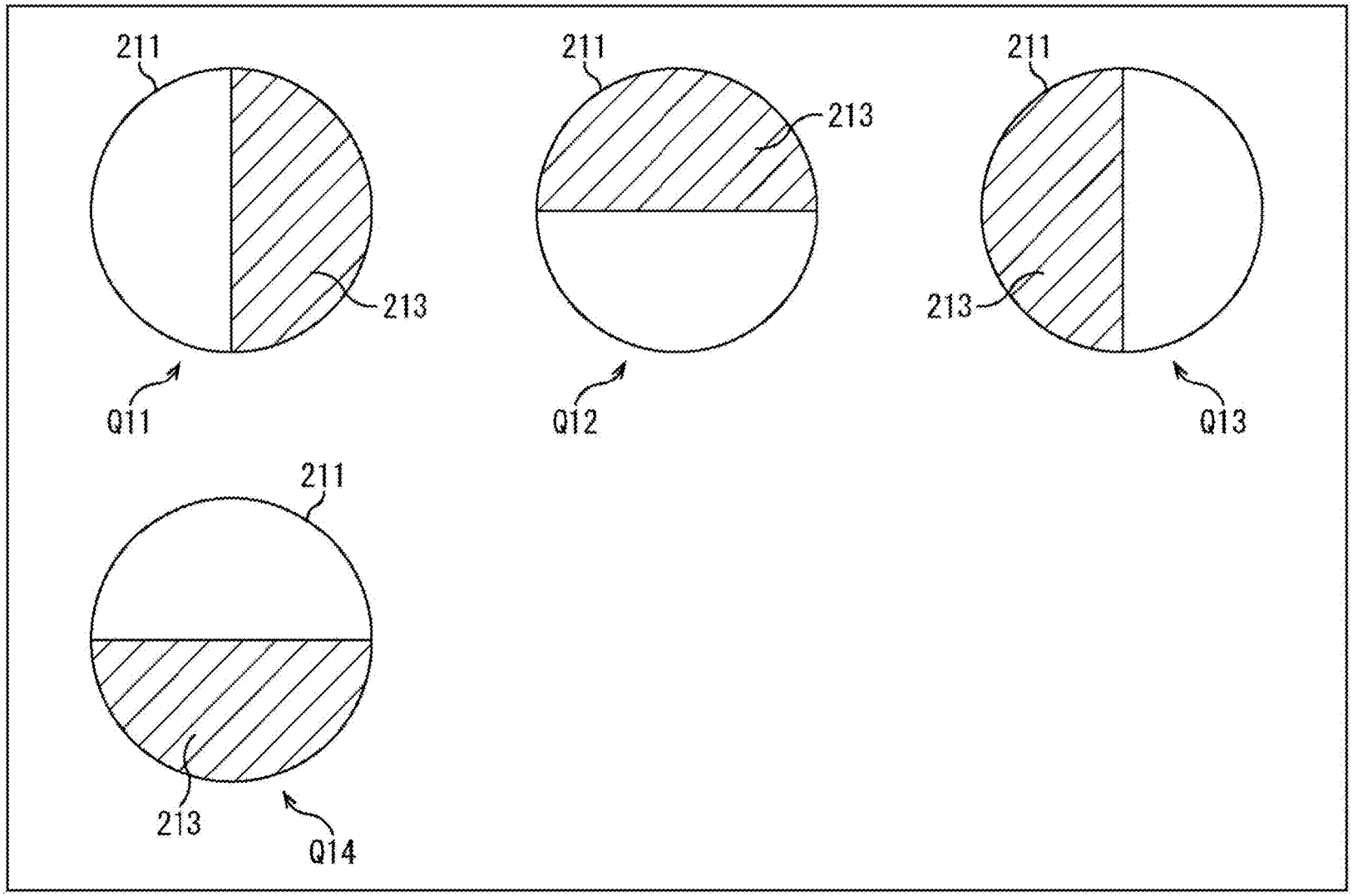
FIG. 9 is a diagram describing a partition in the acoustic tube.

That is, for example, the cross sections at positions indicated by arrows A11 to A15 in the acoustic tube 211 are as illustrated in FIG. 9. Note that in FIG. 9, the same reference signs are provided to the parts corresponding to the case of FIG. 8, and the description will be appropriately skipped.

For example, the cross section of the acoustic tube 211 indicated by an arrow Q11 in FIG. 9 indicates the cross section at the position indicated by the arrow A11 in FIG. 8. In the cross section, the part on the right half in FIG. 9 of the circular shape of the acoustic tube 211 is partitioned by a partition 213, and the sound wave passes through the part on the left half in FIG. 9.

In addition, the cross section of the acoustic tube 211 indicated by an arrow Q12 in FIG. 9 indicates the cross section at the position indicated by the arrow A12 in FIG. 8. The part on the upper half in FIG. 9 of the circular shape of the acoustic tube 211 is partitioned by the partition 213, and the sound wave passes through the remaining part on the lower half.

Furthermore, the cross section of the acoustic tube 211 indicated by an arrow Q13 in FIG. 9 indicates the cross section at the position indicated by the arrow A13 in FIG. 8. The part on the left half in FIG. 9 of the circular shape of the acoustic tube 211 is partitioned by the partition 213, and the sound wave passes through the remaining part on the right half.

The cross section of the acoustic tube 211 indicated by an arrow Q14 in FIG. 9 indicates the cross section at the position indicated by the arrow A14 in FIG. 8. The part on the lower half in FIG. 9 of the circular shape of the acoustic tube 211 is partitioned by the partition 213, and the sound wave passes through the remaining part on the upper half.

Furthermore, the cross section at the position indicated by the arrow A15 in FIG. 8 is the cross section indicated by the arrow Q11 in FIG. 9. In this way, when the cross-sectional position of the acoustic tube 211 is moved in the trailing end direction, the region partitioned by the partition 213 is rotated counterclockwise. Note that although the sound wave passes through only the space on one side of the partition in the example described above, exactly the same sound wave or another sound wave may be able to pass through the space on the other side at the same time.

The partition 213 is provided inside of the acoustic tube 211, and the acoustic path of the acoustic tube 211 is elongated. That is, in the acoustic tube 211, the sound wave output from the speaker 43 goes around the partition inside of the acoustic tube 211 and advances to the trailing end of the acoustic tube 211.

In the acoustic tube 211, the length in the horizontal direction in FIG. 8 from the input end to the trailing end, that is, the external dimension of the acoustic tube 211, is also smaller than the length of the acoustic path of the acoustic tube 211. Therefore, when a sound wave is output from the speaker 43, the sound wave is sequentially emitted from each of the openings 212-1 to 212-6 until the sound wave reaches the trailing end of the acoustic tube 211, and the sound waves are combined to form an evanescent wave. The feature of the modification is that the degree of twist of the partition 213 can be adjusted to relatively easily adjust the compression ratio m from 1 to a larger value while maintaining the external dimension of the acoustic tube 211.

Modification 6 of First Embodiment

<Configuration Example of Acoustic Tube>

Figure 10:
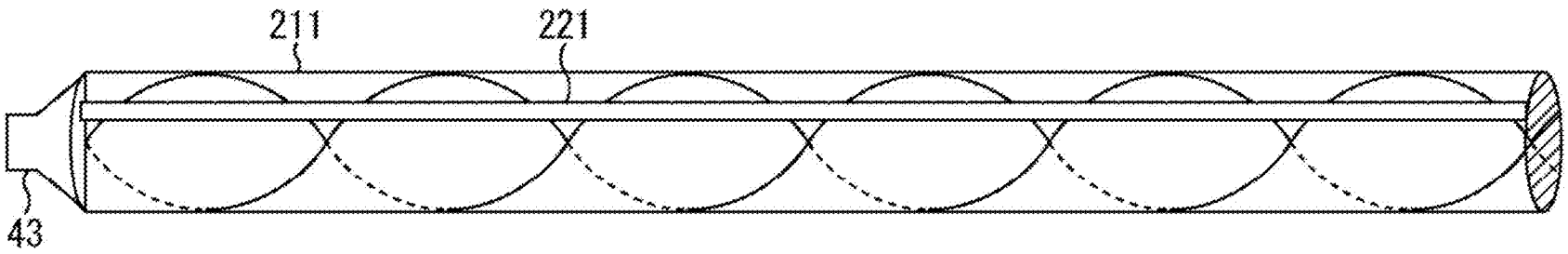
FIG. 10 is a diagram illustrating another configuration example of the acoustic tube.

In addition, the openings provided on the acoustic tube 211 illustrated in FIG. 8 may be formed in a slit shape as illustrated for example in FIG. 10. Note that in FIG. 10, the same reference signs are provided to the parts corresponding to the case of FIG. 8, and the description will be appropriately skipped.

In the example illustrated in FIG. 10, the partition 213 illustrated in FIG. 9 is formed inside of the acoustic tube 211. Furthermore, a rectangular slit 221 is provided as an opening portion on an upper part on the near side of the acoustic tube 211 in FIG. 10 in the example, and the trailing end of the acoustic tube 211 is sealed.

In the example, the input end and the output end of the acoustic tube 211 are the ends of the slit 221, and the slit 221 is an opening in a rectangular shape elongated in the horizontal direction of FIG. 10, that is, a slit shape.

Although only one slit 221 is provided on the acoustic tube 211, the sound wave is emitted to the outside from each of a plurality of positions of the slit 221 at a timing that the sound wave passes through the position until the sound wave output from the speaker 43 reaches the trailing end of the acoustic tube 211. The sound waves emitted from the positions of the slit 221 are then combined to form an evanescent wave.

Note that although one slit 221 is provided on the acoustic tube 211 in FIG. 10, slits may be provided on other positions of the acoustic tube 211.

In addition, other than the examples described with reference to FIGS. 4 to 10, it is only necessary that the acoustic path of the acoustic tube be a path in a shape different from a linear path to make the acoustic path longer than the external dimension, and the examples described with reference to FIGS. 4 to 10 and other examples may be combined.

In addition, the compression ratio m may not be constant from the input end to the trailing end of the acoustic tube. That is, the ratio of the distance of the acoustic tube in the x direction to the distance of the actual acoustic path of the sound wave passing while the sound wave advances in the x direction by the distance may not be constant from the input end to the trailing end of the acoustic tube, that is, may vary depending on the position. Furthermore, the trailing end of the acoustic tube may be an open end or may be a closed end. A sound absorbing material may be provided at the trailing end position to prevent reflection of sound at the trailing end position.

Modification 7 of First Embodiment

<Configuration Example of Acoustic Tube>

Figure 11:
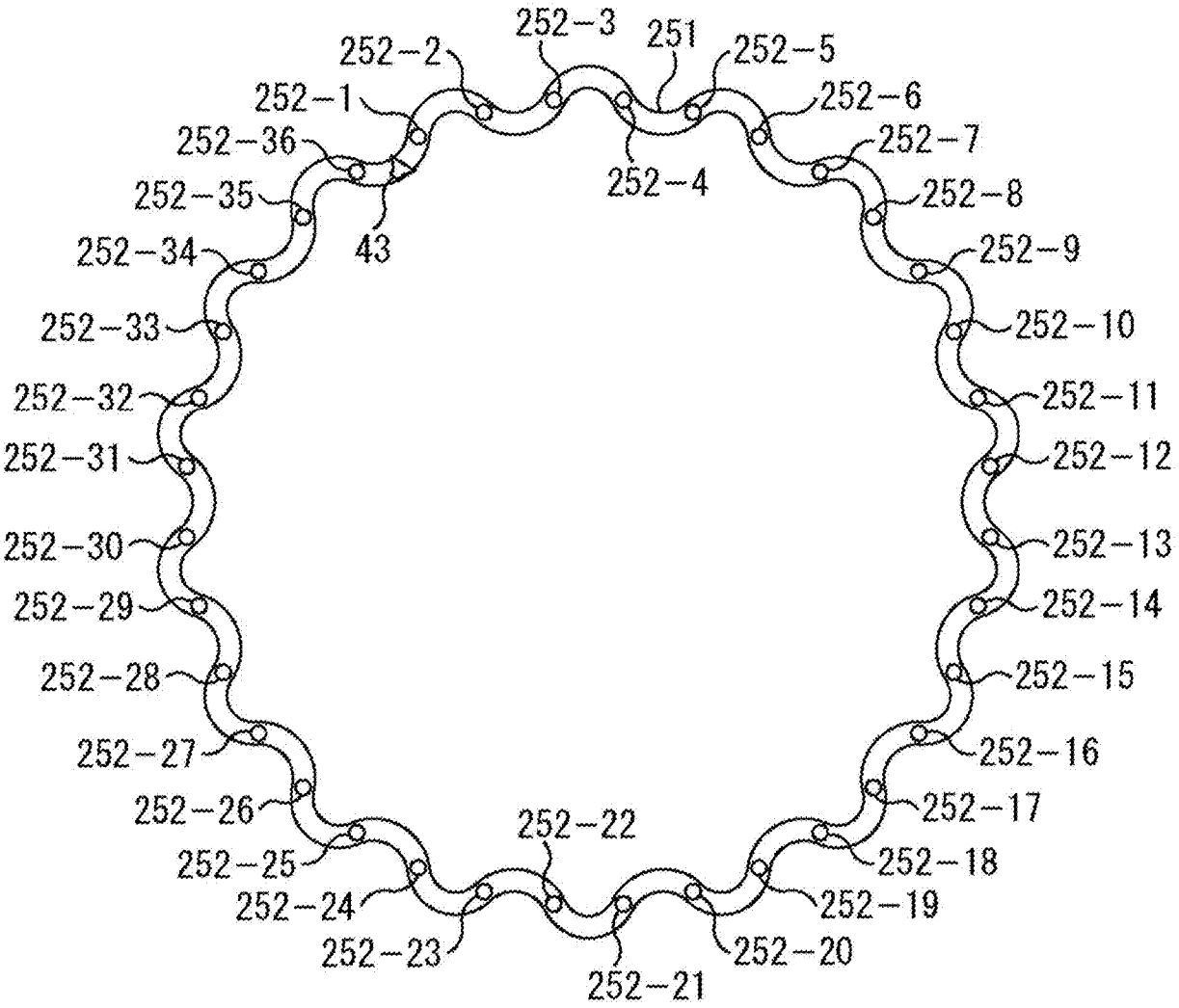
FIG. 11 is a diagram illustrating another configuration example of the acoustic tube.

In addition, the shape of the acoustic tube in a large sense does not have to be a linear shape, and as illustrated for example in FIG. 11, the shape of an acoustic tube 251 in a large sense may be a circular shape, more specifically, an annular shape.

In the example, an acoustic tube 251 is formed by using a tube in the same shape as the wave-shaped acoustic tube 101 illustrated in FIG. 4, that is, a cylindrical tube deformed into a wave shape, and shaping the tube into an annular shape. The input end and the trailing end of the tube are connected.

In addition, the inside of the annular acoustic tube 251 is hollow, and circular openings 252-1 to 252-36 lined up annularly are formed on the near side of the acoustic tube 251 in FIG. 11. In addition, the speaker 43 is connected to an arbitrary position of the acoustic tube 251, and the part connected to the speaker 43 is the input end and the trailing end of the annular acoustic tube 251. Particularly, the input end and the trailing end are at the same position in the example. In other words, the input end and the trailing end are connected.

In the acoustic tube 251, the diameter of the circular acoustic tube 251 in the comprehensive view of the acoustic tube 251, that is, the external dimension of the acoustic tube 251, is also smaller than the length of the acoustic path of the acoustic tube 251, and the evanescent wave can be generated. Furthermore, in the acoustic tube 251, the length of the circumference of the circular acoustic tube 251 in the comprehensive view of the acoustic tube 251 is also smaller than the length of the acoustic path of the acoustic tube 251.

When a sound wave is output from the speaker 43, the sound wave goes around in the acoustic tube 251 through the wave-shaped acoustic path and returns to the position of the speaker 43. In this case, sound waves are emitted from the openings 252-1 to 252-36, and the emitted sound waves are combined to form an evanescent wave.

Note that although one speaker 43 is connected to the acoustic tube 251 in the example described in FIG. 11, the speaker may be connected to each of a plurality of different positions of the acoustic tube 251. In that case, the same voice (sound wave) may be output from each of the plurality of speakers, or different voices (sound waves) may be output from the plurality of speakers.

In addition, although the openings are formed toward the near side in FIG. 11, the openings may be provided toward the inside or the outside of the annular acoustic tube 251, that is, toward the inside or the outside of the ring.

Furthermore, although the acoustic tube 251 is formed by shaping the wave-shaped tube into the annular shape in the example described above, a tube in another shape, such as a mountain shape, may be shaped into an annular shape to form the acoustic tube. Furthermore, although the acoustic tube 251 is annular in the example described above, the shape of the acoustic tube may be any shape, such as a shape further twisting the annular shape and an arc shape.

Modification 8 of First Embodiment

<Configuration Example of Acoustic Reproduction Apparatus>

Figure 12:
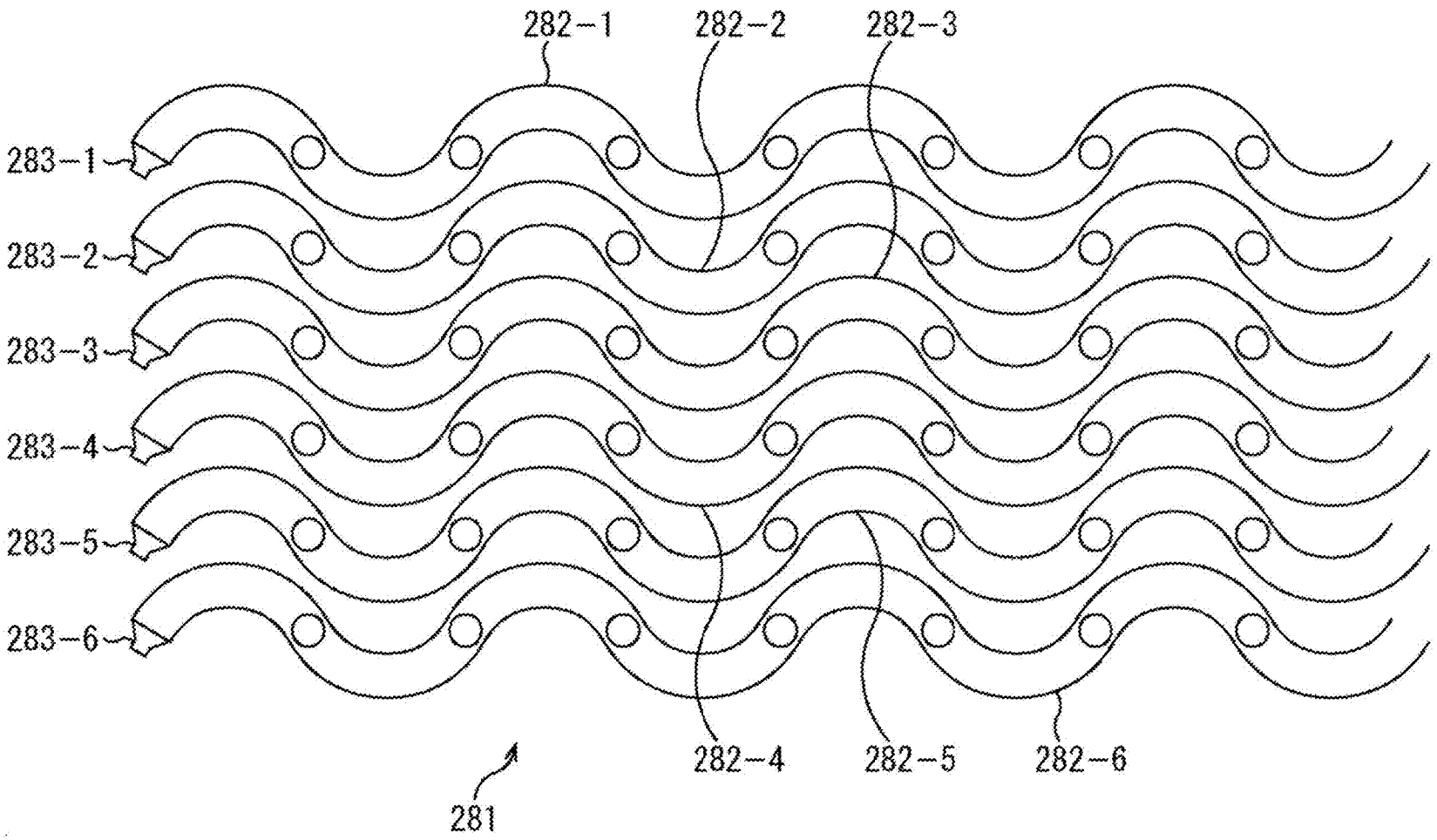
FIG. 12 is a diagram illustrating another configuration example of the acoustic reproduction apparatus.

In addition, although one acoustic tube 41 is provided on the acoustic reproduction apparatus 61 in the case described in the example illustrated in FIG. 3, a plurality of acoustic tubes may be provided on the acoustic reproduction apparatus as illustrated for example in FIG. 12.

In the example illustrated in FIG. 12, six acoustic tubes 282-1 to 282-6 of the same shape are provided on an acoustic reproduction apparatus 281, and speakers 283-1 to 283-6 are connected to input ends of the acoustic tubes 282-1 to 282-6, respectively.

Note that the acoustic tubes 282-1 to 282-6 will also be simply referred to as acoustic tubes 282 in a case where the distinction is not particularly necessary, and the speakers 283-1 to 283-6 will also be simply referred to as speakers 283 in a case where the distinction is not particularly necessary. In addition, other constituent elements of the acoustic reproduction apparatus 281, such as amplifiers and DA conversion units connected to the speakers 283, are not illustrated in the example illustrated in FIG. 12.

Each acoustic tube 282 provided on the acoustic reproduction apparatus 281 is an acoustic tube similar to the acoustic tube 101 illustrated in FIG. 4. That is, an end on the left side of the acoustic tube 282 in FIG. 12 is an input end, and the speaker 283 is connected to the input end. In addition, an end on the right side of each acoustic tube 282 in FIG. 12 is a trailing end, and the trailing end is an open end in the example.

Furthermore, a plurality of circular openings lined up in the horizontal direction in FIG. 12 are provided on each of the wave-shaped acoustic tubes 282, and at the reproduction of voice, sound waves emitted from the openings to the outside of the acoustic tube 282 are combined to form an evanescent wave.

Note that in the acoustic reproduction apparatus 281, the same sound wave may be output at the same time to the plurality of acoustic tubes 282, or different sound waves may be output at the same time to the plurality of acoustic tubes 282.

In addition, the sound waves may be output to the acoustic tubes 282 according to, for example, the language of voice. Specifically, for example, sound waves corresponding to Japanese voice may be output to the acoustic tube 282-1 in a case where Japanese is selected for the voice, and sound waves corresponding to English voice may be output to the acoustic tube 282-2 in a case where English is selected.

Modification 9 of First Embodiment

<Configuration Example of Acoustic Reproduction Apparatus>

Furthermore, in a case where a plurality of acoustic tubes are provided on the acoustic reproduction apparatus, the shape, the length, the thickness, the number of openings, the shape of openings, and the like of the acoustic tubes may vary.

Figure 13:
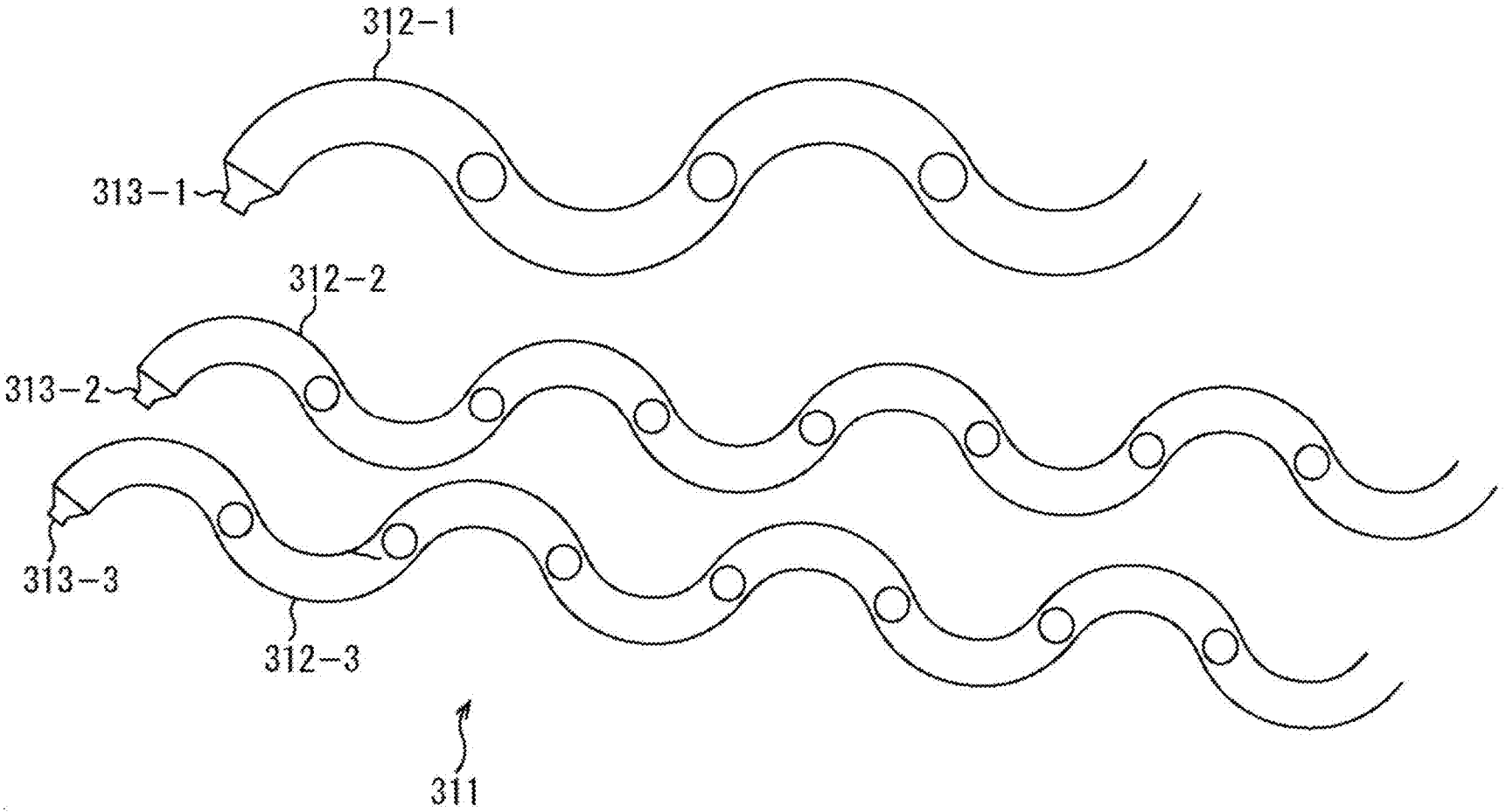
FIG. 13 is a diagram illustrating another configuration example of the acoustic reproduction apparatus.

In such a case, the acoustic reproduction apparatus is configured as illustrated for example in FIG. 13. An acoustic reproduction apparatus 311 illustrated in FIG. 13 includes three acoustic tubes 312-1 to 312-3 and speakers 313-1 to 313-3 connected to input ends of the acoustic tubes 312-1 to 312-3, respectively.

In the acoustic reproduction apparatus 311, the acoustic tubes 312-1 to 312-3 are wave-shaped tubes, and the thickness and the length of the tube of the acoustic tube 312-1 and the thickness and the length of the tubes of the acoustic tubes 312-2 and 312-3 are different. In addition, the shapes of the acoustic tube 312-2 and the acoustic tube 312-3 are the same.

In the example, ends on the left side of the acoustic tubes 312-1 to 312-3 in FIG. 13 are input ends, and ends on the right side of the acoustic tubes 312-1 to 312-3 in FIG. 13 are trailing ends. In addition, the trailing end of each acoustic tube is an open end.

Furthermore, circular openings lined up in the horizontal direction of FIG. 13 are provided on the acoustic tubes 312-1 to 312-3, and the size of openings and the number of provided openings of the acoustic tube 312-1 and the size of openings and the number of provided openings of the acoustic tubes 312-2 and 312-3 are different.

Note that other constituent elements of the acoustic reproduction apparatus 311, such as amplifiers and DA conversion units connected to the speakers, are not illustrated in the example of FIG. 13.

Modification 10 of First Embodiment

<Configuration Example of Acoustic Reproduction Apparatus>

Figure 14:
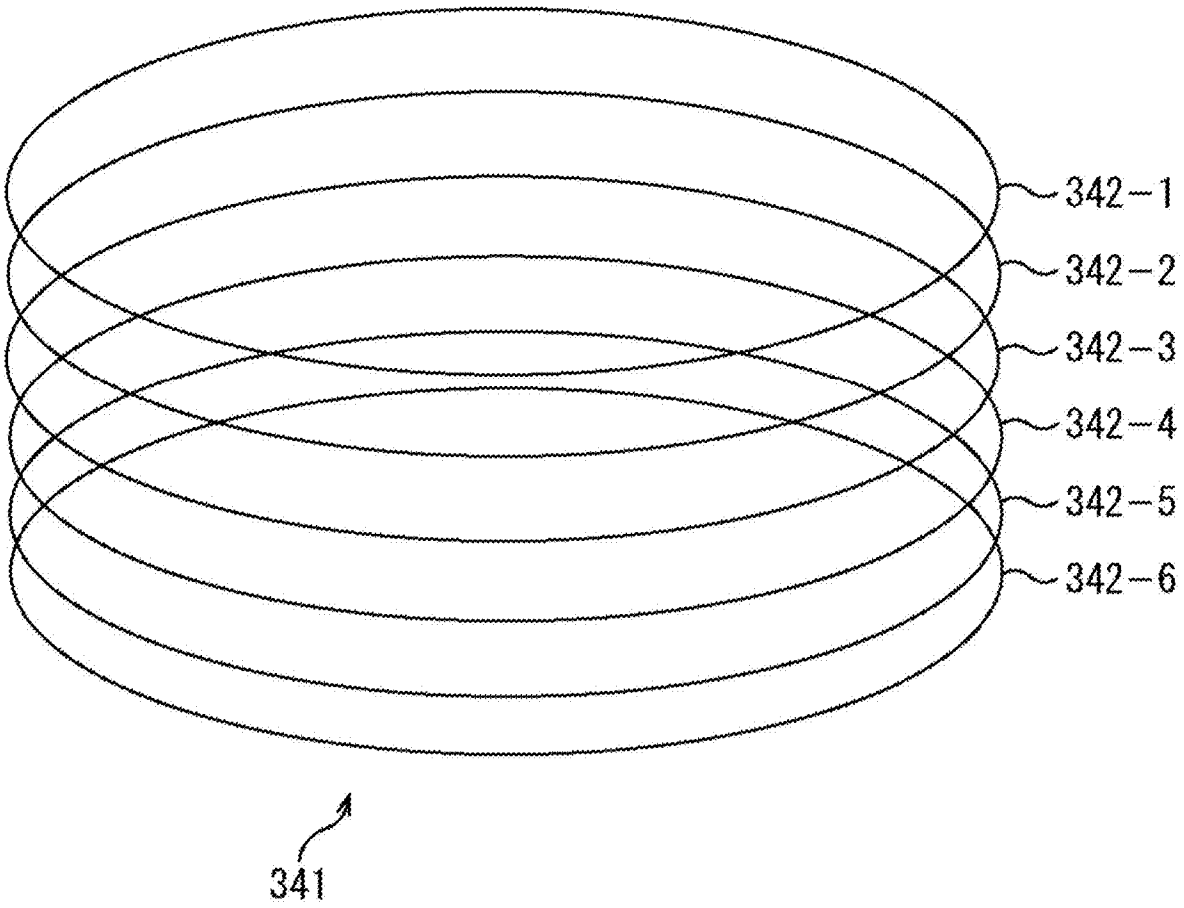
FIG. 14 is a diagram illustrating another configuration example of the acoustic reproduction apparatus.

In addition, a plurality of annular acoustic tubes 342-1 to 342-6 may be provided on an acoustic reproduction apparatus 341 as illustrated for example in FIG. 14. Note that other constituent elements of the acoustic reproduction apparatus 341, such as speakers, amplifiers, and DA conversion units, are not illustrated in FIG. 14.

The acoustic tubes 342-1 to 342-6 provided on the acoustic reproduction apparatus 341 are acoustic tubes similar to, for example, the acoustic tube 251 illustrated in FIG. 11, and the acoustic tubes 342-1 to 342-6 are lined up and arranged in the vertical direction of FIG. 14. Note that the acoustic tubes 342-1 to 342-6 will also be simply referred to as acoustic tubes 342 in a case where the distinction is not particularly necessary.

In the example, the acoustic tubes 342 are equally spaced and lined up, and the diameters of the acoustic tubes 342 are also the same. Note that the acoustic reproduction apparatus 341 is effective in, for example, a case where an advertisement or the like is displayed on a pillar, and the acoustic reproduction apparatus 341 reproduces the voice of the advertisement.

In that case, for example, the acoustic tubes 342 can be arranged along the pillar so as to surround the pillar that displays the advertisement, and the voice of the advertisement that is an evanescent wave can be output from the acoustic tubes 342 to the outside of the pillar. In this case, openings can be formed on each of the acoustic tubes 342 toward the outside of the acoustic tubes 342. In addition, when, for example, a different advertisement is displayed on each region of the pillar, a plurality of speakers can be appropriately connected to the acoustic tubes 342, and different voice can be output from each region of the acoustic tubes 342.

Modification 11 of First Embodiment

<Configuration Example of Acoustic Reproduction Apparatus>

Furthermore, in a case where a plurality of annular acoustic tubes are provided on the acoustic reproduction apparatus, the size, the thickness, the shape, the number of openings, the shape of openings, the interval between openings, and the like of the acoustic tubes may also vary.

Figure 15:
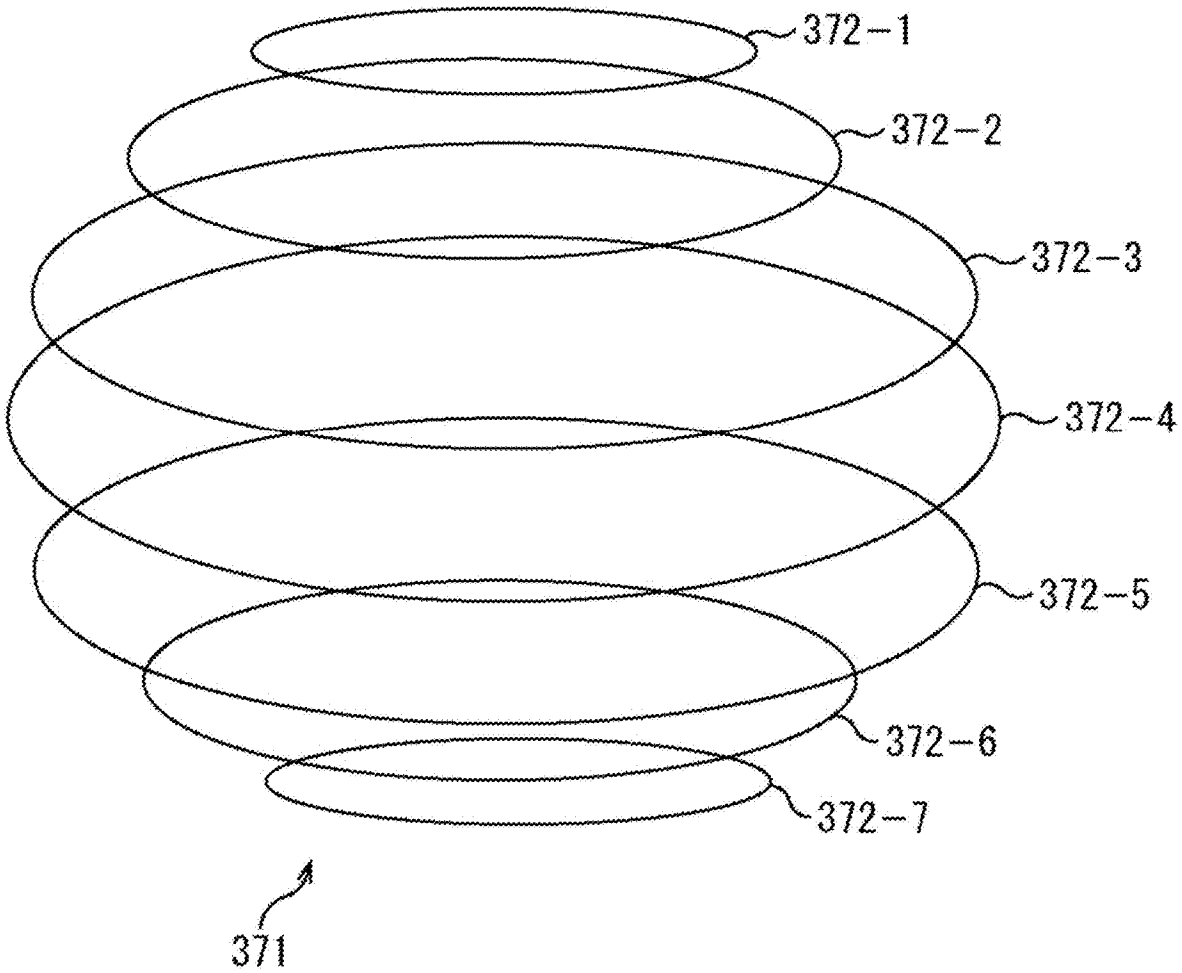
FIG. 15 is a diagram illustrating another configuration example of the acoustic reproduction apparatus.

In such a case, the acoustic reproduction apparatus is configured as illustrated for example in FIG. 15.

An acoustic reproduction apparatus 371 illustrated in FIG. 15 includes a plurality of annular acoustic tubes 372-1 to 372-7. Note that other constituent elements of the acoustic reproduction apparatus 371, such as speakers, amplifiers, and DA conversion units, are not illustrated in FIG. 15.

The acoustic tubes 372-1 to 372-7 provided on the acoustic reproduction apparatus 371 are acoustic tubes similar to, for example, the acoustic tube 251 illustrated in FIG. 11, and only the diameters of the acoustic tubes 372-1 to 372-7 in a large sense, that is, the external dimension, are different.

Note that the acoustic tubes 372-1 to 372-7 will also be simply referred to as acoustic tubes 372 in a case where the distinction is not particularly necessary.

In the example, the acoustic tubes 372 are equally spaced and lined up in the vertical direction in FIG. 15, and the diameters of the acoustic tubes 372 are different. The acoustic reproduction apparatus 371 is effective in, for example, a case where an advertisement or the like is displayed on a pole not in a cylindrical shape, and the acoustic reproduction apparatus 371 reproduces the voice of the advertisement.

Second Embodiment

<Configuration Example of Acoustic Reproduction Apparatus>

In addition, although the sound wave is emitted from each opening 42 in the acoustic reproduction apparatus 61 illustrated in FIG. 3, the sound wave advancing in the acoustic tube 41 is attenuated every time the sound wave is emitted from the opening 42.

Consequently, the sound pressure of the sound wave output from the opening 42 decreases with a decrease in the distance to the trailing end of the acoustic tube 41. Therefore, the sound pressure of the evanescent wave obtained by combining the sound waves from the opening 42, that is, the reproduced sound field, is not symmetric in the x direction with respect to the center of the acoustic tube 41 in a strict sense. That is, the sound field is not bilaterally symmetric.

Figure 16:
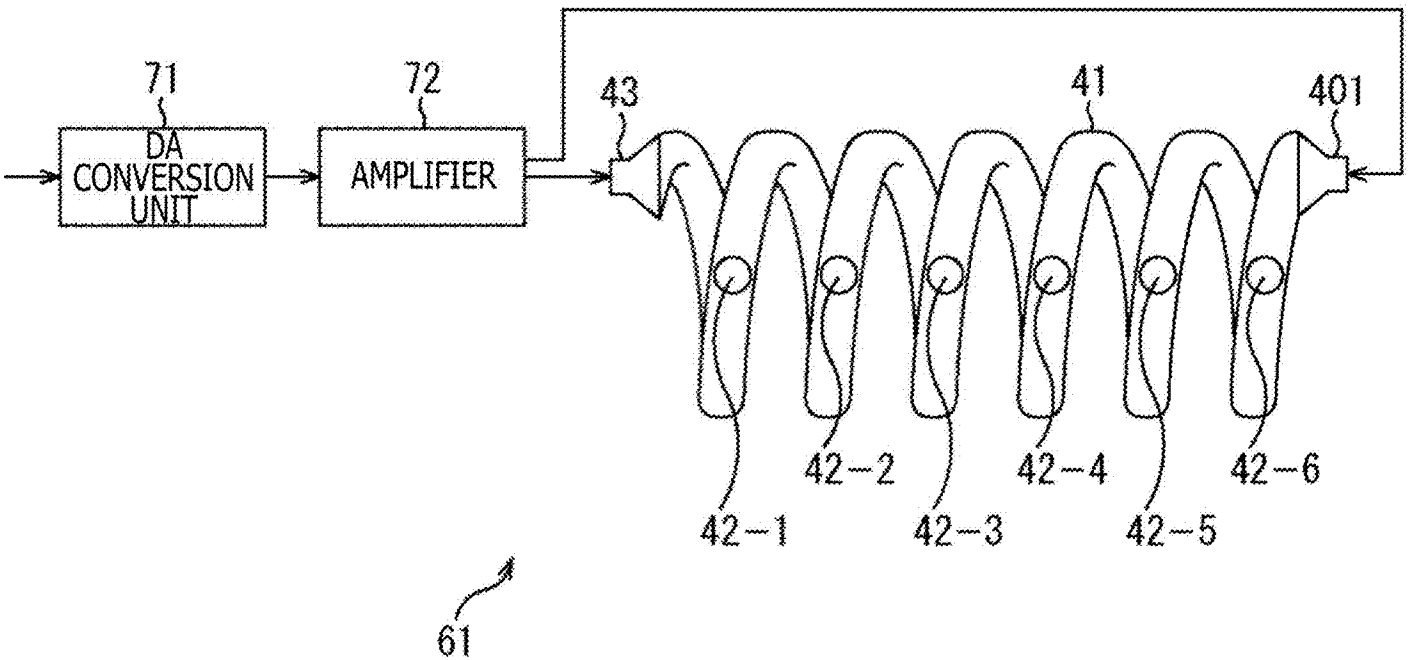
FIG. 16 is a diagram illustrating another configuration example of the acoustic reproduction apparatus.

Thus, speakers may be arranged on both ends of the acoustic tube 41 as illustrated for example in FIG. 16 to allow reproducing a bilaterally symmetric sound field. Note that in FIG. 16, the same reference signs are provided to the parts corresponding to the case of FIG. 3, and the description will be appropriately skipped.

The configuration of the acoustic reproduction apparatus 61 illustrated in FIG. 16 is a configuration in which a speaker 401 is further provided on the acoustic reproduction apparatus 61 illustrated in FIG. 3.

That is, in the acoustic reproduction apparatus 61 illustrated in FIG. 16, the speaker 43 is connected to one end of the acoustic tube 41, and the speaker 401 is connected to the other end of the acoustic tube 41.

The amplifier 72 then supplies the same acoustic signal to the speaker 43 and the speaker 401, and the speaker 43 and the speaker 401 output the same sound wave at the same time on the basis of the acoustic signal supplied from the amplifier 72.

This can reproduce a sound field bilaterally symmetric in the x direction with respect to the center of the acoustic tube 41. Note that the wave number $k_x$ in the x direction of the sound wave outside of the acoustic tube 41 in this case is as indicated in the following Formula (30), and the sound pressure $P(x_v,\omega)$ of the sound wave at the position $x_v$ outside of the acoustic tube 41 is as indicated in the following Formula (31).

[Math. 30]

$$k_x = \pm m\left|\frac{\omega}{c}\right| \tag{30}$$

[Math. 31]

$$\begin{aligned} P(x_v, \omega) &= A(\omega)e^{-\sqrt{k_x^2-(\frac{\omega}{c})^2}\,y}(e^{-ik_x x} + e^{ik_x x}) \\ &= A(\omega)e^{-\sqrt{k_x^2-(\frac{\omega}{c})^2}\,y}(\cos k_x x) \end{aligned} \tag{31}$$

It can be recognized from Formula (31) that a standing wave is produced in the x direction outside of the acoustic tube 41.

Third Embodiment

<Configuration Example of Acoustic Reproduction Apparatus>

Furthermore, in the acoustic reproduction apparatus 61 illustrated in FIG. 3, the wave number $k_y$ in the y direction is as indicated in the following Formula (32) as described with reference to Formula (27). Therefore, the change in the sound pressure in the y direction is as indicated in the following Formula (33).

[Math. 32]

$$k_y = \pm i\frac{\omega}{c}\sqrt{m^2 - 1} \tag{32}$$

[Math. 33]

$$P(y, \omega) = A(\omega)\exp\left(-\frac{\omega}{c}\sqrt{m^2 - 1y}\right) \tag{33}$$

Note that P(y,ω) in Formula (33) denotes sound pressure at each position in the y direction outside of the acoustic tube. As can be recognized from Formula (33), the sound pressure P(y,ω) in the y direction is suddenly attenuated with an increase in the angular frequency co.

Therefore, frequency characteristic correction as acoustic correction can be applied in advance to the acoustic signal supplied to the speaker to reduce the dependence of the sound pressure P(y,ω) on the angular frequency co.

For example, a correction factor G(ω) of each angular frequency (ω) for realizing correction for making the frequency characteristics flat at the position y=1 in the y direction is represented by an equation illustrated in the following Formula (34).

[Math. 34]

$$G(\omega)A(\omega)\exp\left(-\frac{\omega}{c}\sqrt{m^2 - 1}\right) = aA(\omega) \tag{34}$$

Note that in Formula (34), a is a constant. A solution indicated in the following Formula (35) is obtained by solving the equation indicated in Formula (34).

[Math. 35]

$$G(\omega) = a\exp\left(\frac{\omega}{c}\sqrt{m^2 - 1}\right) \tag{35}$$

The correction factor G(ω) obtained in this way can be used to correct components of each angular frequency ω of the acoustic signal, and an evanescent wave with flat frequency characteristics, that is, level frequency characteristics, can be obtained at the position y=1. In other words, the sound pressure of the components of each angular frequency ω can be equal at the position y=1.

Figure 17:
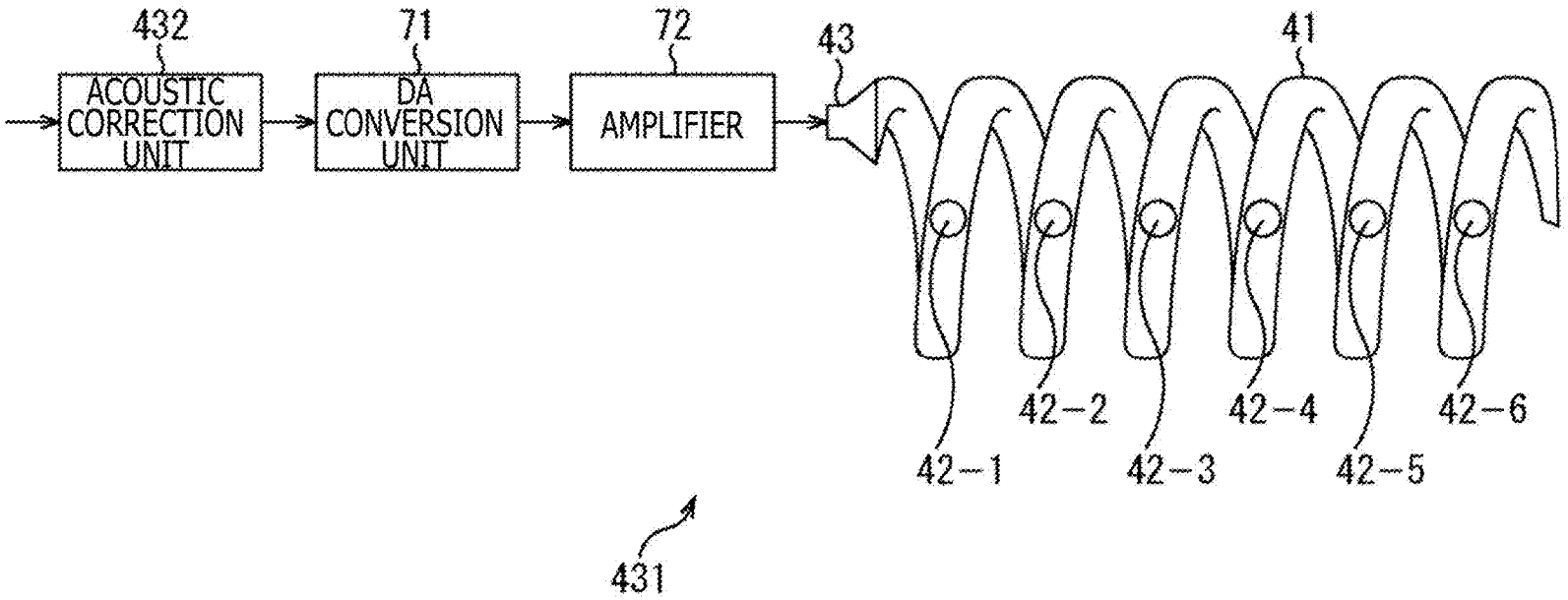
FIG. 17 is a diagram illustrating another configuration example of the acoustic reproduction apparatus.

In the case of correcting the frequency characteristics, the acoustic reproduction apparatus is configured as illustrated for example in FIG. 17. Note that in FIG. 17, the same reference signs are provided to the parts corresponding to the case of FIG. 3, and the description will be appropriately skipped.

An acoustic reproduction apparatus 431 illustrated in FIG. 17 includes an acoustic correction unit 432, the DA conversion unit 71, the amplifier 72, the speaker 43, and the acoustic tube 41.

The configuration of the acoustic reproduction apparatus 431 is a configuration in which the acoustic correction unit 432 is further provided on the configuration of the acoustic reproduction apparatus 61 illustrated in FIG. 3.

In the example, a digital acoustic signal is supplied to the acoustic correction unit 432, and the acoustic correction unit 432 applies acoustic correction to the supplied acoustic signal and supplies the acoustic signal obtained as a result of the acoustic correction to the DA conversion unit 71.

More specifically, for example, the correction factor G(ω) held in advance is used to correct the frequency characteristics in the acoustic correction. In the correction of the frequency characteristics by the acoustic correction unit 432, the components of each angular frequency ω of the acoustic signal is multiplied by the correction factor G(ω) to perform the correction.

The DA conversion unit 71 converts the acoustic signal supplied from the acoustic correction unit 432 from a digital signal to an analog signal and supplies the signal to the amplifier 72. The amplifier 72 amplifies the analog acoustic signal supplied from the DA conversion unit 71 and supplies the signal to the speaker 43. The speaker 43 then reproduces the voice on the basis of the acoustic signal supplied from the amplifier 72. That is, the speaker 43 outputs the sound wave on the basis of the acoustic signal into the acoustic tube 41.

As a result, sound waves are output from the acoustic tube 41, and the sound waves are combined to generate an evanescent wave with flat frequency characteristics at the position y=1.

Note that although the frequency characteristics of the acoustic signal are corrected in the digital domain in the example described here, the frequency characteristics may be corrected in the analog domain, such as in the preceding stage or the subsequent stage of the amplifier 72.

In addition, although the frequency characteristics are corrected to make the frequency characteristics flat at the position y=1 in the example described here, any other frequency characteristic correction may be performed.

Fourth Embodiment

<Configuration Example of Acoustic Reproduction Apparatus>

Furthermore, in the example described in the third embodiment, the acoustic characteristic correction, that is, frequency characteristic correction, is performed as a method of suppressing the sudden attenuation of the sound pressure $P(y,\omega)$ in the y direction with an increase in the angular frequency $\omega$. In addition, the bandwidth of the acoustic signal may also be divided to reduce the difference in the attenuation of the sound pressure in each angular frequency $\omega$.

Note that although the number of divisions in dividing the bandwidth of the acoustic signal can be an arbitrary number, the number of divisions is two in the example described here.

Figure 18:
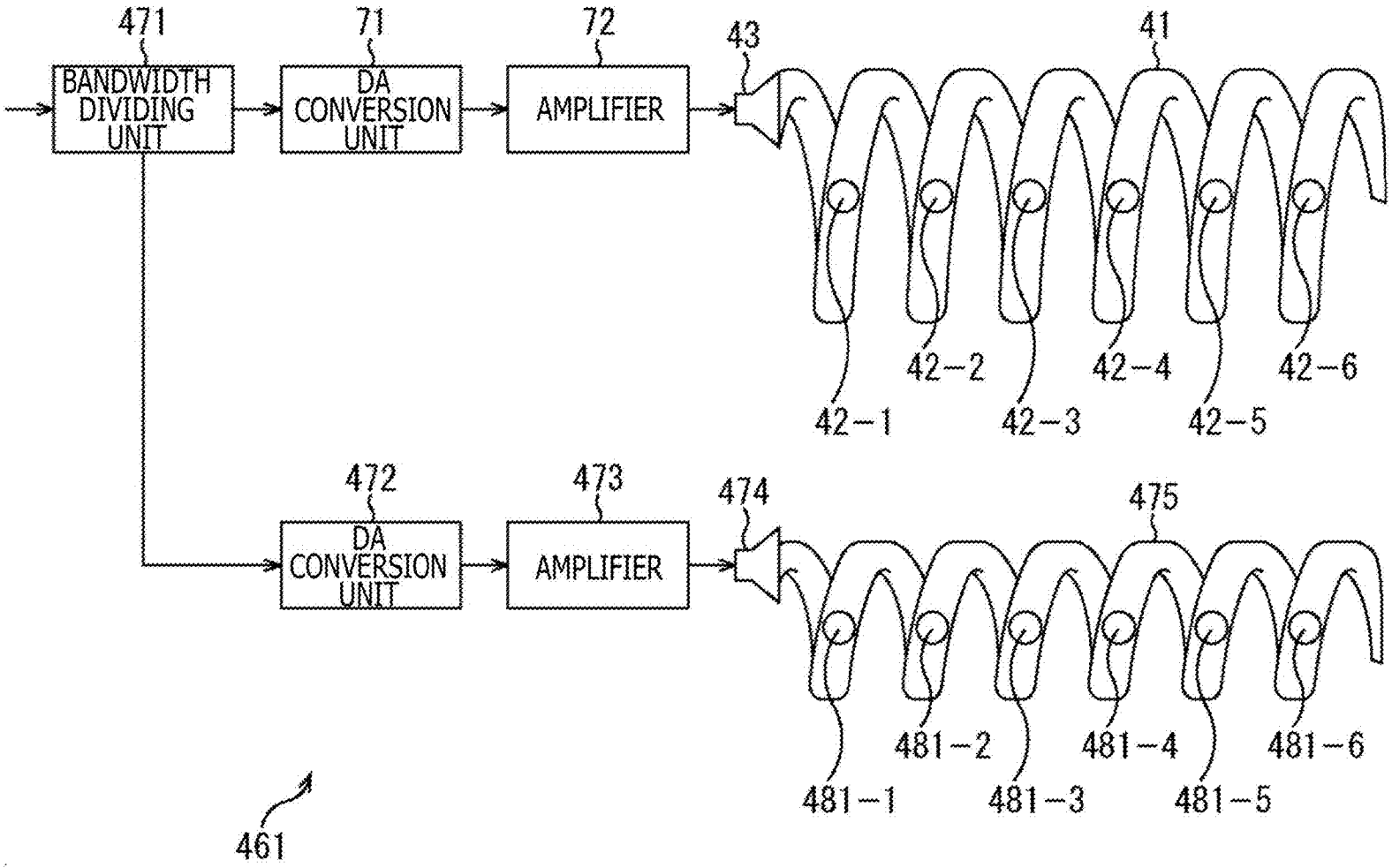
FIG. 18 is a diagram illustrating another configuration example of the acoustic reproduction apparatus.

In the case of dividing the acoustic signal into two bandwidths, the acoustic reproduction apparatus is configured as illustrated for example in FIG. 18. Note that in FIG. 18, the same reference signs are provided to the parts corresponding to the case of FIG. 3, and the description will be appropriately skipped.

An acoustic reproduction apparatus 461 illustrated in FIG. 18 includes a bandwidth dividing unit 471, the DA conversion unit 71, the amplifier 72, the speaker 43, the acoustic tube 41, a DA conversion unit 472, an amplifier 473, a speaker 474, and an acoustic tube 475.

Here, the DA conversion unit 472, the amplifier 473, the speaker 474, and the acoustic tube 475 correspond to the DA conversion unit 71, the amplifier 72, the speaker 43, and the acoustic tube 41, respectively.

In addition, the acoustic tube 475 includes openings 481-1 to 481-6, and the positions of the openings 481-1 to 481-6 in the x direction are the same as the positions of the openings 42-1 to 42-6 of the acoustic tube 41, respectively. Furthermore, the length of the acoustic tube 41 and the length of the acoustic tube 475 in the x direction are also the same.

Note that the openings 481-1 to 481-6 will also be simply referred to as openings 481 in a case where the distinction is not particularly necessary.

Although the shape of the acoustic tube 475 is basically the same as the shape of the acoustic tube 41, the width of the acoustic tube 475 in the y direction, that is, the width in the vertical direction in FIG. 18, is different in a large sense. In other words, the compression ratio m of the acoustic path varies between the acoustic tube 41 and the acoustic tube 475.

Hereinafter, the compression ratio m in the acoustic tube 41 will be referred to as a compression ratio $m=m_1$, and the compression ratio m in the acoustic tube 475 will be referred to as a compression ratio $m=m_2$.

The bandwidth dividing unit 471 uses, for example, a bandwidth dividing filter or the like to execute a filtering process or the like to divide the bandwidth of the supplied acoustic signal and divides the acoustic signal into signals of two bandwidths. That is, acoustic signals of two different angular frequency bands are generated.

The bandwidth dividing unit 471 supplies the acoustic signal of one of the bandwidths obtained by dividing the bandwidth to the DA conversion unit 71 and supplies the acoustic signal of the other bandwidth to the DA conversion unit 472.

Hereinafter, the bandwidth of the acoustic signal supplied toward the DA conversion unit 71, that is, the angular frequency $\omega$ of the reproduction bandwidth reproduced by the acoustic tube 41 will also be referred to as an angular frequency $\omega=\omega_1$, and the angular frequency co of the reproduction bandwidth reproduced by the acoustic tube 475 will also be referred to as an angular frequency $\omega=\omega_2$.

The acoustic signal supplied from the bandwidth dividing unit 471 to the DA conversion unit 71 is converted into an analog signal by the DA conversion unit 71. The signal is then amplified by the amplifier 72 and supplied to the speaker 43, and the speaker 43 outputs the sound wave on the basis of the acoustic signal into the acoustic tube 41.

In addition, the DA conversion unit 472 converts the acoustic signal supplied from the bandwidth dividing unit 471 from a digital signal to an analog signal and supplies the signal to the amplifier 473. The amplifier 473 amplifies the acoustic signal supplied from the DA conversion unit 472 and supplies the acoustic signal to the speaker 474. The speaker 474 then reproduces the voice on the basis of the acoustic signal supplied from the amplifier 473. That is, the speaker 474 outputs the sound wave on the basis of the acoustic signal into the acoustic tube 475.

At the reproduction of the acoustic signal in the acoustic reproduction apparatus 461, the acoustic tube 41 generates an evanescent wave with the bandwidth of angular frequency $\omega=\omega_1$, and the acoustic tube 475 generates an evanescent wave with the bandwidth of angular frequency $\omega=\omega_2$.

In this way, the acoustic reproduction apparatus 461 can use the acoustic tubes with different compression ratios m to reproduce the acoustic signals with bandwidths of different angular frequencies $\omega$ to thereby reduce the difference in the attenuation of the sound pressure $P(y,\omega)$ in the y direction depending on the angular frequency co.

Specifically, although the number of divisions of reproduction bandwidth and the range of bandwidth are arbitrary, it is assumed here that the angular frequency $\omega=\omega_1$ of the reproduction bandwidth of the acoustic tube 41 is $\omega_0/20<\omega_1\leq\omega_0$, and the angular frequency $\omega=\omega_2$ of the reproduction bandwidth of the acoustic tube 475 is $\omega_0<\omega_2 20\omega_0$, for example.

In this case, the relationship between the compression ratio $m_1$ of the acoustic tube 41 and the compression ratio $m_2$ of the acoustic tube 475 will be considered such that the sound pressure of angular frequency $\omega=\omega_1$ at the position in the y direction outside of the acoustic tube 41 and the sound pressure of the angular frequency $\omega=20\omega_1$ at the position in the y direction outside of the acoustic tube 475 are equal in all the angular frequencies $\omega_1$.

First, the sound pressure $P_1(y,\omega)$ at the position in the y direction outside of the acoustic tube 41 and the sound pressure $P_2(y,\omega)$ at the position in the y direction outside of the acoustic tube 475 are as indicated in the following Formulas (36) and (37), respectively.

[Math. 36]

$$P_1(y,\omega)=A(\omega)\exp\left(-\frac{\omega}{c}\sqrt{m_1^2-1}\ y\right) \tag{36}$$

[Math. 37]

$$P_2(y,\omega)=A(\omega)\exp\left(-\frac{\omega}{c}\sqrt{m_2^2-1}\ y\right) \tag{37}$$

Here, the relationship between the compression ratio $m_1$ and the compression ratio $m_2$ where the sound pressure is $P_1(y,\omega_1)=P_2(y,20\omega_1)$ is calculated from Formula (36) and Formula (37), and the following Formula (38) is obtained.

[Math. 38]

$$A(\omega)\exp\left(-\frac{\omega_1}{c}\sqrt{m_1^2-1}\ y\right)=A(\omega)\exp\left(-\frac{20\omega_1}{c}\sqrt{m_2^2-1}\ y\right) \quad (38)$$

$$-\frac{\omega_1}{20c}\sqrt{m_1^2-1}\ y=-\frac{\omega_1}{c}\sqrt{m_2^2-1}\ y$$

$$m_2=\frac{1}{20}\sqrt{m_1^2-399}$$

Therefore, for example, the acoustic tube 41 and the acoustic tube 475 in the relationship of compression ratio indicated in Formula (38) are used in the acoustic reproduction apparatus 461 illustrated in FIG. 18. In this case, when the acoustic reproduction apparatus 461 generates the evanescent wave based on the acoustic signal, the sound pressure of the components of the angular frequency $\omega_1$ and the sound pressure of the components of the angular frequency $20\omega_1$ corresponding to the angular frequency are equal at an arbitrary position in the y direction. This can further reduce the difference in the attenuation of the sound pressure in the y direction in each angular frequency ω.

Note that in the case of dividing the bandwidth of the acoustic signal, speakers suitable for each reproduction bandwidth are used. In this regard, in a case where the diameter of the speakers varies in each reproduction bandwidth, tubes with different diameters are also prepared as the acoustic tubes connected to the speakers. This can prevent mismatch of acoustic impedance, and the energy can be more effectively transmitted into the acoustic tubes.

For example, in a case where the diameter of the speaker 43 is greater than the diameter of the speaker 474 in the acoustic reproduction apparatus 461, the diameter of the tube of the acoustic tube 41 can also be changed to the size corresponding to the diameter of the speaker 43 to prevent the mismatch of acoustic impedance. In this case, the diameter of the tube of the acoustic tube 41 is greater than the diameter of the tube of the acoustic tube 475.

In addition, two acoustic tubes are provided on the acoustic reproduction apparatus, and the two acoustic tubes reproduce sound in different angular frequency bands in the example described here. However, three or more acoustic tubes may be provided, and the acoustic tubes may reproduce sound in different angular frequency bands. Furthermore, in a case where a plurality of acoustic tubes are provided on the acoustic reproduction apparatus, some of the acoustic tubes may reproduce sound in the same angular frequency band. That is, in a case where a plurality of sets of acoustic tubes and speakers are provided on the acoustic reproduction apparatus, the plurality of acoustic tubes may include acoustic tubes with different compression ratios m and acoustic tubes with the same compression ratio m.

Modification 1 of Fourth Embodiment

<Configuration Example of Acoustic Reproduction Apparatus>

In addition, although the bandwidth of the acoustic signal is divided in the digital domain in the case described for the acoustic reproduction apparatus 461 illustrated in FIG. 18, the bandwidth of the acoustic signal may be divided in the analog domain. In that case, the acoustic reproduction apparatus is configured as illustrated for example in FIG. 19. Note that in FIG. 19, the same reference signs are provided to the parts corresponding to the case of FIG. 18, and the description will be appropriately skipped.

Figure 19:
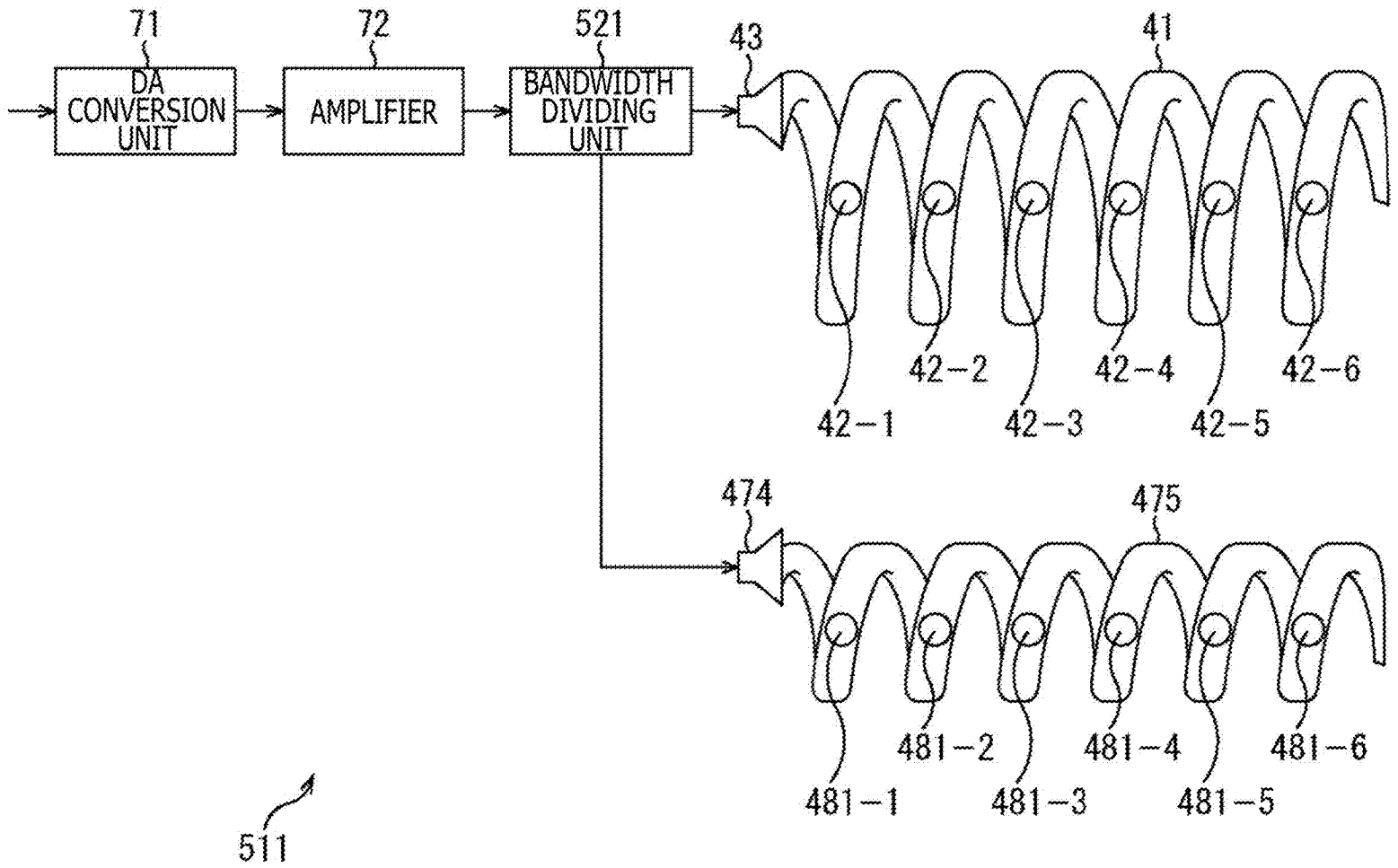
FIG. 19 is a diagram illustrating another configuration example of the acoustic reproduction apparatus.

An acoustic reproduction apparatus 511 illustrated in FIG. 19 includes the DA conversion unit 71, the amplifier 72, a bandwidth dividing unit 521, the speaker 43, the acoustic tube 41, the speaker 474, and the acoustic tube 475.

In the example, the acoustic signal supplied to the DA conversion unit 71 is converted into an analog signal by the DA conversion unit 71 and supplied to the amplifier 72, and the acoustic signal is further amplified by the amplifier 72 and supplied to the bandwidth dividing unit 521.

The bandwidth dividing unit 521 includes, for example, an RC circuit or an LCR circuit and divides the acoustic signal supplied from the amplifier 72 into signals of two bandwidths. The bandwidth dividing unit 521 supplies the acoustic signal of one of the bandwidths obtained by dividing the bandwidth to the speaker 43 and supplies the acoustic signal of the other bandwidth to the speaker 474.

In this way, a plurality of DA conversion units and amplifiers do not have to be provided in the case of dividing the bandwidth of the acoustic signal in the analog domain. In addition, although the bandwidth is divided in the subsequent stage of the amplifier 72 in the example described here, the bandwidth may be divided in the preceding stage of the amplifier 72. In that case, the bandwidth dividing unit 521 divides the bandwidth of the analog acoustic signal supplied from the DA conversion unit 71, and the amplifiers need to be provided between the bandwidth dividing unit 521 and the speaker 43 and between the bandwidth dividing unit 521 and the speaker 474. That is, a total of two amplifiers are necessary.

Fifth Embodiment

<Configuration Example of Acoustic Reproduction Apparatus>

Although the example of correcting the frequency characteristics of the acoustic signal and the example of dividing the bandwidth of the acoustic signal are described above, the correction of the frequency characteristics and the division of the bandwidth may be combined. The combination of the correction of the frequency characteristics and the division of the bandwidth is effective in reducing the difference in the attenuation of the sound pressure in the y direction in each angular frequency co.

Figure 20:
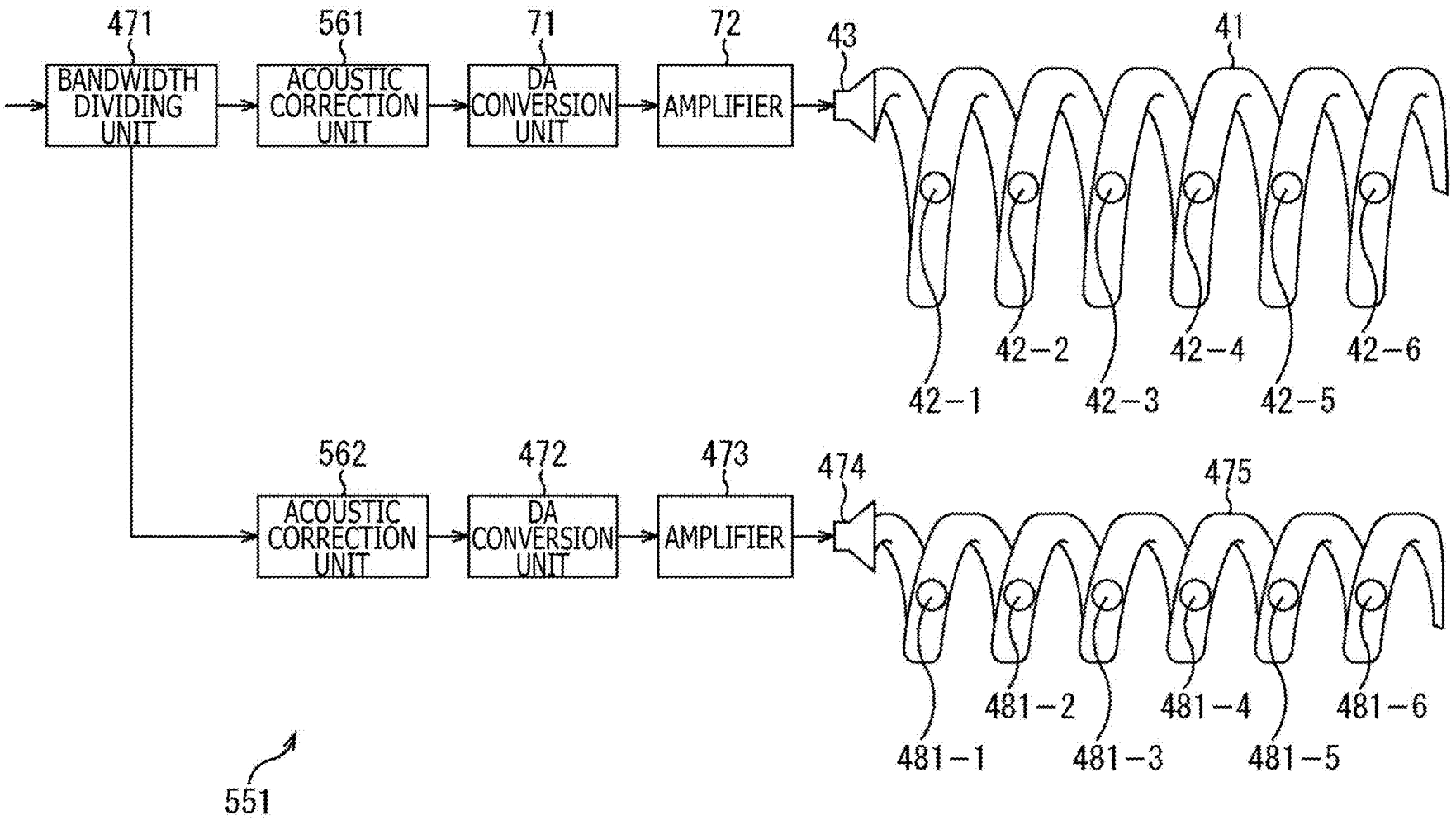
FIG. 20 is a diagram illustrating another configuration example of the acoustic reproduction apparatus.

In the case of combining the correction of the frequency characteristics and the division of the bandwidth, the acoustic reproduction apparatus is configured as illustrated for example in FIG. 20. Note that in FIG. 20, the same reference signs are provided to the parts corresponding to the case of FIG. 18, and the description will be appropriately skipped.

An acoustic reproduction apparatus 551 illustrated in FIG. 20 includes the bandwidth dividing unit 471, an acoustic correction unit 561, the DA conversion unit 71, the amplifier 72, the speaker 43, the acoustic tube 41, an acoustic correction unit 562, the DA conversion unit 472, the amplifier 473, the speaker 474, and the acoustic tube 475.

The configuration of the acoustic reproduction apparatus 551 is a configuration in which the acoustic correction unit 561 and the acoustic correction unit 562 are further provided on the acoustic reproduction apparatus 461 illustrated in FIG. 18.

That is, the acoustic correction unit 561 is provided between the bandwidth dividing unit 471 and the DA conversion unit 71, and the acoustic correction unit 562 is provided between the bandwidth dividing unit 471 and the DA conversion unit 472.

The acoustic correction unit 561 uses a correction factor held in advance to correct the frequency characteristics of the acoustic signal after the bandwidth division supplied from the bandwidth dividing unit 471 and supplies the acoustic signal obtained as a result of the correction to the DA conversion unit 71. Similarly, the acoustic correction unit 562 uses a correction factor held in advance to correct the frequency characteristics of the acoustic signal after the bandwidth division supplied from the bandwidth dividing unit 471 and supplies the acoustic signal obtained as a result of the correction to the DA conversion unit 472. The acoustic correction unit 561 and the acoustic correction unit 562 correspond to the acoustic correction unit 432 illustrated in FIG. 17.

Note that the correction factor for each angular frequency ω held by the acoustic correction unit 561 will also be referred to as $G_1(\omega)$, and the correction factor for each angular frequency ω held by the acoustic correction unit 562 will also be referred to as $G_2(\omega)$.

In addition, the angular frequency ω of the bandwidth of the acoustic signal supplied to the acoustic correction unit 561, that is, the reproduction bandwidth reproduced by the acoustic tube 41, will also be referred to as an angular frequency $\omega=\omega_1$, and the angular frequency ω of the reproduction bandwidth reproduced by the acoustic tube 475 will also be referred to as an angular frequency $\omega=\omega_2$. Here, $\omega_0/20<\omega_1\leq\omega_0$ and $\omega_0<\omega_2\leq 20\omega_0$ hold.

Furthermore, the compression ratio m in the acoustic tube 41 will be referred to as a compression ratio $m=m_1$, and the compression ratio m in the acoustic tube 475 will be referred to as a compression ratio $m=m_2$.

By the way, in the example of the correction factor G(ω) in the acoustic reproduction apparatus 431 described with reference to FIG. 17, the correction factor G(ω) is calculated to make the frequency characteristics flat when y=1. In that case, the sound pressure P(y,ω) in the y direction of the outside of the acoustic tube is as indicated in the following Formula (39).

[Math. 39]

$$P(y,\omega)=G(\omega)A(\omega)\exp\left(-\frac{\omega}{c}\sqrt{m^2-1}\,y\right)=aA(\omega)\exp\left(-\frac{\omega}{c}\sqrt{m^2-1}\,(y-1)\right) \tag{39}$$

As can be recognized from Formula (39), the sound pressure P(y,ω) increases with an increase in the angular frequency ω in a region of y<1, and the sound pressure P(y,ω) decreases with an increase in the angular frequency ω in a region of y>1. That is, flat frequency characteristics cannot be obtained in the regions other than y=1.

In addition, the relationship between the compression ratio $m_1$ and the compression ratio $m_2$ where the sound pressure is $P_1(y,\omega_1)=P_2(y,20\omega_1)$ is calculated in the acoustic reproduction apparatus 461 that divides the bandwidth as described with reference to FIG. 18.

However, when, for example, the ratio of the sound pressure $P_1(y,\omega_0/20)$ to the sound pressure $P_1(y,\omega_0)$ where y=1 is calculated in that case, the ratio is as indicated in the following Formula (40), and the sound pressure in the y direction is still suddenly attenuated with an increase in the angular frequency ω.

[Math. 40]

$$\frac{P_1(1,\omega_0)}{P_1\left(1,\frac{\omega_0}{20}\right)}=\exp\left(\frac{\omega_0-\frac{\omega_0}{20}}{c}\sqrt{m_1^2-1}\right)=\exp\left(-\frac{19\omega_0}{20c}\sqrt{m_1^2-1}\right) \tag{40}$$

Therefore, the acoustic reproduction apparatus 551 corrects the frequency characteristics and divides the bandwidth, and in this case, for example, the following conditions are set to control the sound field. In this way, flat frequency characteristics can be obtained, and the difference in the attenuation of the sound pressure in each angular frequency ω can be reduced.

That is, for example, the correction factor $G_1(\omega)$, the correction factor $G_2(\omega)$, the compression ratio $m_1$, and the compression ratio $m_2$ are calculated such that the frequency characteristics are flat at the point y=1, and the sound pressure is $P_1(y,\omega_1)=P_2(y,20\omega_1)$. The correction factors and the compression ratios are used in the acoustic reproduction apparatus 551.

First, the sound pressure P(y,ω) in the y direction outside of the acoustic tube is defined as in the following Formula (41).

[Math. 41]

$$P(y,\omega)=\begin{cases}P_1(y,\omega) & \left(\frac{\omega_0}{20}<\omega\leq\omega_0\right)\\ P_2(y,\omega) & (\omega_0<\omega\leq 20\omega_0)\end{cases} \tag{41}$$

In this case, $P_1(y,\omega)$ and $P_2(y,\omega)$ in Formula (41) are as in the following Formulas (42) and (43), respectively.

[Math. 42]

$$P_1(y,\omega)=G_1(\omega)A(\omega)\exp\left(-\frac{\omega}{c}\sqrt{m_1^2-1}\,y\right) \tag{42}$$

[Math. 43]

$$P_2(y,\omega)=G_2(\omega)A(\omega)\exp\left(-\frac{\omega}{c}\sqrt{m_2^2-1}\,y\right) \tag{43}$$

Here, the correction factor $G_1(\omega)$ and the correction factor $G_2(\omega)$ are calculated such that the sound pressure P(y,ω) where y=1 is constant regardless of the angular frequency ω, and the sound pressure $P_1(y,\omega)$, that is, the correction factor $G_1(\omega)$ is as indicated in the following Formula (44).

$$G_1(\omega)A(\omega)\exp\left(-\frac{\omega}{c}\sqrt{m_1^2-1}\right)=aA(\omega)$$

$$G_1(\omega)=a\exp\left(\frac{\omega}{c}\sqrt{m_1^2-1}\right) \tag{44}$$

Similar to the correction factor $G_1(\omega)$, the sound pressure $P_2(y,\omega)$, that is, the correction factor $G_2(\omega)$, is as indicated in the following Formula (45).

[Math. 45]

$$G_2(\omega)=a\exp\left(\frac{\omega}{c}\sqrt{m_2^2-1}\right) \tag{45}$$

Next, Formula (44) and Formula (45) are used to solve the equation as indicated in the following Formula (46), and the compression ratio $m_1$ and the compression ratio $m_2$ are calculated such that the sound pressure is $P_1(y,\omega_1)=P_2(y, 20\omega_1)$ regardless of the position in the y direction.

[Math. 46]

$$G_1(\omega)A(\omega)\exp\left(-\frac{\omega_1}{c}\sqrt{m_1^2-1}\ y\right) = G_2(\omega)A(\omega)\exp\left(-\frac{20\omega_1}{c}\sqrt{m_2^2-1}\ y\right) \tag{46}$$

$$a\exp\left(-\frac{\omega_1}{c}\sqrt{m_1^2-1}\ (y-1)\right) = a\exp\left(-\frac{20\omega_1}{c}\sqrt{m_2^2-1}\ (y-1)\right)$$

$$\frac{\omega_1}{c}\sqrt{m_1^2-1}\ (y-1) = \frac{20\omega_1}{c}\sqrt{m_2^2-1}\ (y-1)$$

$$\frac{1}{20}\sqrt{m_1^2-1} = \sqrt{m_2^2-1}$$

$$m_2 = \frac{1}{20}\sqrt{m_1^2-399}$$

In the acoustic tube 41 and the acoustic tube 475 of the acoustic reproduction apparatus 551, the compression ratio $m_1$ of the acoustic tube 41 and the compression ratio $m_2$ of the acoustic tube 475 are in the relationship indicated in Formula (46).

Furthermore, in the acoustic reproduction apparatus 551, the acoustic correction unit 561 uses the correction factor $G_1(\omega)$ indicated in Formula (44) to correct the frequency characteristics of the acoustic signal, and the acoustic correction unit 562 uses the correction factor $G_2(\omega)$ indicated in Formula (45) to correct the frequency characteristics of the acoustic signal.

In this way, the frequency characteristics are flat at the point y=1 outside of the acoustic tube in the acoustic reproduction apparatus 551, and the sound pressure $P_1(y, \omega_1)=P_2(y,20\omega_1)$ holds in all the angular frequencies $\omega_l$ (where $\omega_0/20<\omega_1\omega_0$). That is, the evanescent wave with more flat frequency characteristics and less difference in the attenuation of the sound pressure in the y direction in each angular frequency ω can be generated.

Note that in the case of combining the correction of the frequency characteristics and the division of the bandwidth, the acoustic correction unit 432 illustrated in FIG. 17 may be provided in the preceding stage of the DA conversion unit 71 in the acoustic reproduction apparatus 511 illustrated in FIG. 19, for example.

In that case, the acoustic correction unit 432 uses different correction factors G(ω) for each bandwidth of the angular frequency ω to correct the frequency characteristics of the acoustic signal supplied from the outside and supplies the acoustic signal obtained as a result of the correction to the DA conversion unit 71 as indicated for example in the following Formula (47).

[Math. 47]

$$G(\omega) = \begin{cases} G_1(\omega) & \left(\frac{\omega_0}{20} < \omega \le \omega_0\right) \\ G_2(\omega) & (\omega_0 < \omega \le 20\omega_0) \end{cases} \tag{47}$$

In the example, the acoustic correction unit 432 performs the acoustic correction, that is, the frequency characteristic correction, in all the bandwidths of the acoustic signal, and the bandwidth dividing unit 521 then divides the bandwidth of the acoustic signal in the analog domain. Furthermore, in this case, the compression ratio $m_1$ of the acoustic tube 41 and the compression ratio $m_2$ of the acoustic tube 475 are in the relationship indicated in Formula (46) in the acoustic tube 41 and the acoustic tube 475 of the acoustic reproduction apparatus 511.

Furthermore, for example, the acoustic correction unit 432 illustrated in FIG. 17 may be provided in the preceding stage of the bandwidth dividing unit 471 in the acoustic reproduction apparatus 461 illustrated in FIG. 18.

In that case, the acoustic correction unit 432 uses, for example, the correction factor G(ω) indicated in Formula (47) to correct, in all the bandwidths, the frequency characteristics of the acoustic signal supplied from the outside and supplies the acoustic signal obtained as a result of the correction to the bandwidth dividing unit 471.

In the example, the bandwidth dividing unit 471 divides the bandwidth of the acoustic signal in the digital domain. Furthermore, in this case, the compression ratio $m_1$ of the acoustic tube 41 and the compression ratio $m_2$ of the acoustic tube 475 are in the relationship indicated in Formula (46) in the acoustic tube 41 and the acoustic tube 475 of the acoustic reproduction apparatus 461.

Note that the correction factors and the compression ratios described in the third to fifth embodiments are examples only, and the values may be defined by other condition setting. It is obvious that the embodiments and the modifications described above can be appropriately combined.

In addition, the embodiments of the present technique are not limited to the embodiments described above, and various changes can be made without departing from the scope of the present technique.

For example, the present technique can be provided as cloud computing in which a plurality of apparatuses share one function and cooperate to execute a process through a network.

The advantageous effects described in the present specification are illustrative only and are not limited. There can be other advantageous effects.

Furthermore, the present technique can also be configured as follows.

(1)

An acoustic tube including:

an acoustic path longer than an external dimension of the acoustic tube; and a plurality of opening portions or a slit-like opening portion.

(2)

The acoustic tube according to (1), in which the plurality of opening portions are lined up and provided in a predetermined direction.

(3)

The acoustic tube according to (1) or (2), in which the plurality of opening portions are provided such that a distance between the opening portions adjacent to each other is a predetermined distance.

(4)

The acoustic tube according to any one of (1) to (3), in which the acoustic path is shaped such that a speed of a sound wave in a predetermined direction is lower than a speed of the sound wave advancing in the acoustic path.

(5)

The acoustic tube according to any one of (1) to (4), in which the acoustic tube outputs a sound wave from each of the plurality of opening portions or outputs a sound wave from each of a plurality of positions of the slit-like opening portion to generate an evanescent wave.

(6)

The acoustic tube according to any one of (1) to (5), in which the acoustic tube is obtained by winding a cylindrical tube to form a spiral shape.

(7)

The acoustic tube according to any one of (1) to (5), in which the acoustic tube is obtained by using a cylindrical tube deformed into a wave shape and shaping the tube into an annular shape.

(8)

The acoustic tube according to any one of (1) to (5), in which the acoustic tube is obtained by providing a partition inside.

(9)

An acoustic reproduction apparatus including:

an acoustic tube including an acoustic path longer than an external dimension of the acoustic tube, and a plurality of opening portions or a slit-like opening portion; and a speaker that outputs a sound wave into the acoustic tube.

(10)

The acoustic reproduction apparatus according to (9), in which the acoustic path is shaped such that a speed of the sound wave in a predetermined direction is lower than a speed of the sound wave advancing in the acoustic path.

(11)

The acoustic reproduction apparatus according to (9) or (10), in which the acoustic tube outputs the sound wave from each of the plurality of opening portions or outputs the sound wave from each of a plurality of positions of the slit-like opening portion to generate an evanescent wave.

(12)

The acoustic reproduction apparatus according to any one of (9) to (11), including:

a plurality of speakers that output sound waves into the acoustic tube.

(13)

The acoustic reproduction apparatus according to any one of (9) to (12), further including:

an acoustic correction unit that applies acoustic correction to an acoustic signal to be supplied to the speaker.

(14)

The acoustic reproduction apparatus according to any one of (9) to (13), including:

a plurality of acoustic tubes and a plurality of speakers.

(15)

The acoustic reproduction apparatus according to (14), further including:

a bandwidth dividing unit that divides a bandwidth of an acoustic signal to generate each of a plurality of acoustic signals to be output to each of the plurality of speakers.

(16)

The acoustic reproduction apparatus according to (14) or (15), in which the plurality of acoustic tubes include the acoustic tubes, each having a different ratio of a first distance in a predetermined direction to a second distance of advance of the sound wave advancing in the acoustic path while the sound wave advances in the predetermined direction by the first distance.

REFERENCE SIGNS LIST

41 Acoustic tube, 42-1 to 42-6, 42 Openings, 43 Speaker, 61 Acoustic reproduction apparatus, 71 DA conversion unit, 72 Amplifier, 432 Acoustic correction unit, 471 Bandwidth dividing unit

The invention claimed is:

1. An acoustic tube comprising:

an acoustic path longer than an external dimension of the acoustic tube; and a plurality of opening portions or a slit-like opening portion, wherein sound waves input to the acoustic tube are emitted from the acoustic tube through the plurality of opening portions or through the slit-like opening portion to an outside of the acoustic tube, and wherein the acoustic path is shaped such that a speed of sound waves advancing in a predetermined direction from an input end to a trailing end of the acoustic tube is lower than the speed of the sound waves advancing in the acoustic path.

2. The acoustic tube according to claim 1, wherein the plurality of opening portions are lined up and provided in a predetermined direction.

3. The acoustic tube according to claim 1, wherein the plurality of opening portions are provided such that a distance between the opening portions adjacent to each other is a predetermined distance.

4. The acoustic tube according to claim 1, wherein the acoustic tube outputs the sound waves from each of the plurality of opening portions or outputs the sound waves from each of a plurality of positions of the slit-like opening portion to generate an evanescent wave.

5. The acoustic tube according to claim 1, wherein the acoustic tube is obtained by winding a cylindrical tube to form a spiral shape.

6. The acoustic tube according to claim 1, wherein the acoustic tube is obtained by using a cylindrical tube deformed into a wave shape and shaping the tube into an annular shape.

7. The acoustic tube according to claim 1, wherein the acoustic tube is obtained by providing a partition inside.

8. An acoustic reproduction apparatus comprising:

an acoustic tube including an acoustic path longer than an external dimension of the acoustic tube, and a plurality of opening portions or a slit-like opening portion; and a speaker that outputs sound saves into the acoustic tube, wherein the sound waves are emitted from the acoustic tube through the plurality of opening portions or through the slit-like opening portion to an outside of the acoustic tube, and wherein the acoustic path is shaped such that a speed of sound waves advancing in a predetermined direction from an input end to a trailing end of the acoustic tube is lower than the speed of the sound waves advancing in the acoustic path.

9. The acoustic reproduction apparatus according to claim 8, wherein the acoustic tube outputs the sound waves from each of the plurality of opening portions or outputs the sound waves from each of a plurality of positions of the slit-like opening portion to generate an evanescent wave.

10. The acoustic reproduction apparatus according to claim 8, comprising:

a plurality of speakers that output sound waves into the acoustic tube.

11. The acoustic reproduction apparatus according to claim 8, further comprising:

an acoustic correction unit that applies acoustic correction to an acoustic signal to be supplied to the speaker.

12. The acoustic reproduction apparatus according to claim 8, comprising:

a plurality of acoustic tubes and a plurality of speakers.

13. The acoustic reproduction apparatus according to claim 12, further comprising:

a bandwidth dividing unit that divides a bandwidth of an acoustic signal to generate each of a plurality of acoustic signals to be output to each of the plurality of speakers.

14. The acoustic reproduction apparatus according to claim 12, wherein the plurality of acoustic tubes include the acoustic tubes, each having a different ratio of a first distance in a predetermined direction to a second distance of advance of the sound waves advancing in the acoustic path while the sound waves advance in the predetermined direction by the first distance.

* * * * *